US008746152B2

(12) United States Patent
Charney et al.

(10) Patent No.: US 8,746,152 B2
(45) Date of Patent: Jun. 10, 2014

(54) LOW PROFILE DISCHARGE GATE ASSEMBLY FOR A RAILROAD HOPPER CAR

(75) Inventors: Richard M. Charney, South Milwaukee, WI (US); Brian A. Senn, South Milwaukee, WI (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 192 days.

(21) Appl. No.: 13/200,027

(22) Filed: Sep. 15, 2011

(65) Prior Publication Data

US 2013/0068127 A1 Mar. 21, 2013

(51) Int. Cl.
*B61D 7/20* (2006.01)
*B61D 7/02* (2006.01)

(52) U.S. Cl.
USPC ..... 105/282.1; 105/282.3

(58) Field of Classification Search
USPC ..... 105/305, 282.1–282.3
See application file for complete search history.

(56) References Cited

U.S. PATENT DOCUMENTS

| | | | |
|---|---|---|---|
| 2,142,236 | A | 1/1939 | Campbell |
| 2,644,408 | A | 7/1953 | Dorey |
| 2,749,770 | A | 6/1956 | Dorey |
| 3,110,270 | A | 11/1963 | Ingram |
| 3,248,026 | A | 4/1966 | Kemp |
| 3,344,748 | A | 10/1967 | Dorey |
| 3,387,570 | A | 6/1968 | Pulcrano et al. |
| 3,415,204 | A | 12/1968 | Pase |
| 3,446,538 | A | 5/1969 | Danielson |
| 3,682,105 | A | 8/1972 | Marulic |
| 3,683,820 | A | 8/1972 | Floehr |
| 3,709,152 | A | 1/1973 | Gutridge |
| 3,837,294 | A | 9/1974 | Fossett |
| 3,893,398 | A | 7/1975 | Fischer |
| 3,933,100 | A | 1/1976 | Dugge |
| 3,956,996 | A | 5/1976 | Fischer |
| 4,094,254 | A | 6/1978 | Koranda |
| 4,253,400 | A | 3/1981 | Fischer et al. |
| 4,256,042 | A | 3/1981 | Fischer |
| 4,342,267 | A | 8/1982 | Blout |
| 5,046,432 | A | 9/1991 | Bowler |

(Continued)

OTHER PUBLICATIONS

Miner Enterprises, Inc.; Discharge Valve Assembly; Drawing No. EN-30179; Oct. 10, 1975; USA.

(Continued)

*Primary Examiner* — Zachary Kuhfuss
(74) *Attorney, Agent, or Firm* — Law Office of John W. Harbst

(57) ABSTRACT

A low profile discharge gate assembly including a rigid frame defining a generally rectangular discharge opening and a gate slidably mounted on the frame for controlling discharge of commodity from the gate assembly. Structure carried by and extending inwardly from the frame is arranged between a lower surface on the gate and boot flanges defined by the gate assembly frame for restricting the flow of commodity from the gate assembly. A vertical distance of less than 7.5 inches separates the boot flanges from mounting flanges on the gate assembly frame whereby permitting a conventional unloading sled to fit under the gate assembly to discharge commodity therefrom. An operating shaft assembly selectively controls movement of the gate between open and closed positions. A lock assembly is also provided for inhibiting inadvertent movement of the gate from the closed position toward the open position.

56 Claims, 17 Drawing Sheets

(56) References Cited

U.S. PATENT DOCUMENTS

| | | | |
|---|---|---|---|
| 5,272,987 | A | 12/1993 | Lucas |
| 5,448,955 | A | 9/1995 | Dugge et al. |
| 5,507,235 | A | 4/1996 | Dugge et al. |
| 5,671,684 | A | 9/1997 | Lucas |
| RE35,925 | E | 10/1998 | Dohr et al. |
| 5,829,359 | A | 11/1998 | Dohr et al. |
| 6,363,863 | B1 | 4/2002 | Dohr |
| 6,899,038 | B2 | 5/2005 | Fortuna |
| 8,371,235 | B1 * | 2/2013 | Early ..... 105/247 |

OTHER PUBLICATIONS

Miner Enterprises, Inc.; Gate Assembly; Drawing No. M-77-1; Mar. 20, 1995; USA.

Miner Enterprises, Inc.: 13×42 Gate Assembly; Drawing No. M-99-31; Apr. 24, 1998; USA.

Miner Enterprises, Inc.; 24×54 AutoLOKII 64 Hole Gate Arrangement; Drawing No. M-169-21; Sep. 9, 2009; USA.

* cited by examiner

FIG. 15
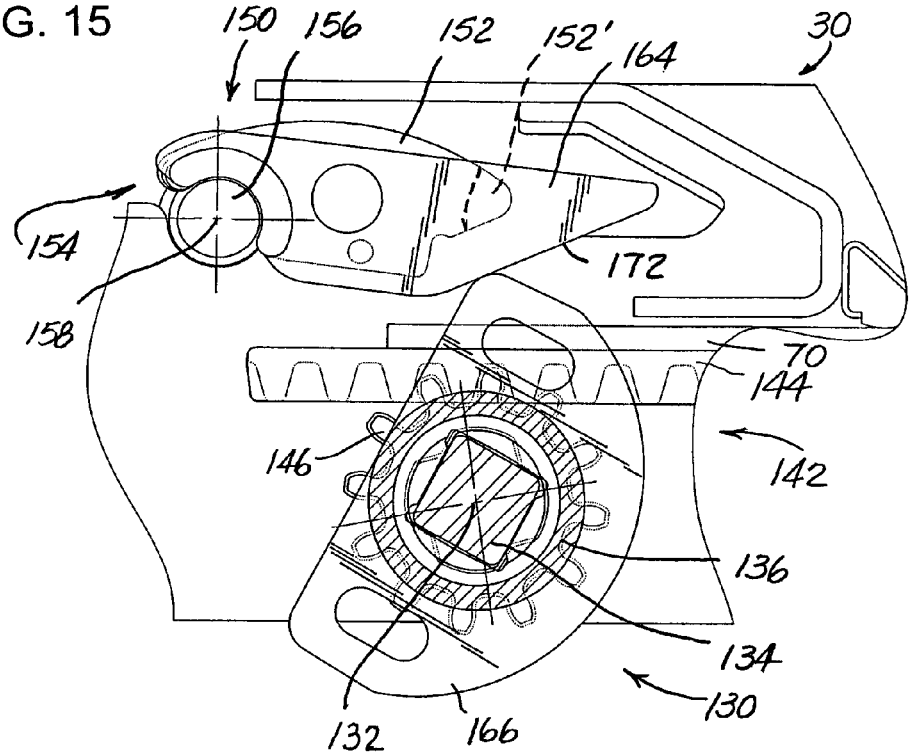
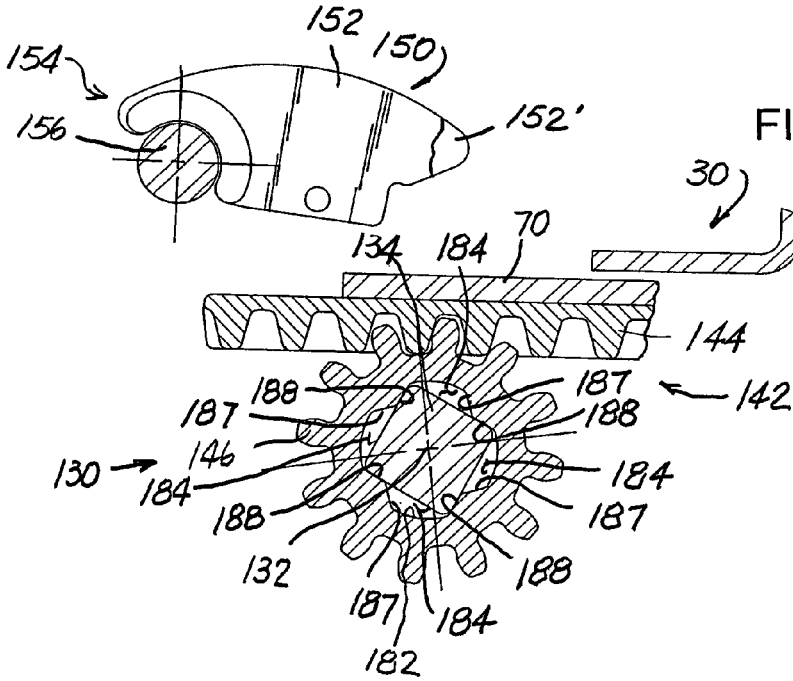
FIG. 16

LOW PROFILE DISCHARGE GATE ASSEMBLY FOR A RAILROAD HOPPER CAR

FIELD OF THE INVENTION DISCLOSURE

The present invention disclosure generally relates to railroad hopper cars and, more particularly, to a low profile discharge gate assembly for a railroad hopper car.

BACKGROUND

Railroad hopper cars are commonly used to economically transport commodities between distantly spaced geographic locations. Dry granular commodities can be rapidly discharged from the hopper car through gate assemblies mounted in material receiving relation relative to standard openings on a bottom of the hopper car. Each gate assembly typically includes a frame defining a discharge opening. A gate is slidably movable on the frame and a drive mechanism is provided for moving the gate between closed and open positions. In a closed position, the gate prevents discharge of the commodity from the hopper car. When the gate is opened, the commodity is gravitationally discharged through the discharge opening defined by the gate assembly.

Hopper cars typically include a mounting flange provided about each standard opening on the bottom of the hopper car. Such hopper car mounting flanges typically define a series of apertures or openings arranged in a generally standard bolting pattern. The gate assembly frame includes, toward an upper end thereof, a mounting flange designed to facilitate securement of the gate assembly to the hopper car. A transition wall section angles inwardly from the mounting flange on the gate assembly frame toward the discharge opening for the gate assembly.

Once a hopper car reaches an unloading site, the gate on the gate assembly is opened and gravity causes the commodity within the walled enclosure or hopper on the car to freely drop from the railcar's hopper through the discharge opening and into a take-away device. There are several common options for the take-away device. One option involves an open-pit having conveyance equipment, i.e., a belt-conveyor or pneumatic conveyor arranged toward a bottom thereof. A second option involves a sealed pit using unloading "boots." With this device, a boot is raised from beneath and between the rails and seals against a "boot flange" on the bottom of the gate assembly. During discharge, the commodity falls from the hopper, passing into the boot, from whence the commodity is directed toward and deposited onto conveyance equipment under the rails. These unloading boots are available in several standard sizes.

Another common option for directing a discharged commodity from the hopper car involves use of a portable unloading sled having a selectively operable conveyor. Unlike unloading pits, which are more or less permanently located, portable unloading sleds allow unloading of the railcar at almost any location where the railcar can be safely parked and accessed. These portable unloading sleds are specifically designed to fit between the top or upper surface of the rails and the bottom of the discharge gate assembly. To reduce the commodity lost during discharge and transfer of the commodity, the portable sleds seal against the "boot flange" on the bottom of the gate assembly.

Prior to the discharge of commodity from the railcar, the portable unloading sled is wheeled or otherwise moved into place on top of the rails and under the discharge outlet of the gate assembly. The conveyor is engaged or otherwise "turned ON" and the gate of the gate assembly is thereafter opened.

The unloading sled serves to convey the commodity received from the hopper of the railcar into silos, truck-trailers, or is simply deposited onto the ground.

To reduce their costs while adding versatility to railcar usage, railroad car builders and manufacturers desire a railcar having a discharge gate assembly which is suitable for use with and promotes unloading of the hopper car using either unloading "boots" and/or portable sled unloading devices. Many factors and design considerations, however, converge to make the railcar manufacturer's wants and desires difficult to accomplish.

A railcar hopper car discharge gate assembly design is complicated considering portable unloading sleds require a certain amount or degree of clearance between the top or upper surface of the rails and a lowermost surface on the lower or "boot" flange on the gate assembly. Adding complexity to the gate design is the fact railcar builders and manufacturers have been designing the gate assembly mounting flange on the bottom of the railcar as low as possible. Such a car design advantageously increases the cubic capacity of the railcar while also beneficially lowering the center of gravity of the car.

Bolting a standard and heretofore known gate assembly to the lowered mounting flange on the railcar unfortunately results in insufficient rail clearance for safe movement of the railcar over vertical curves and related track equipment, i.e., switches and the like. Moreover, bolting a standard and heretofore known gate assembly to the lowered mounting flange on the railcar does not provide sufficient space and clearance whereby allowing a portable unloading sled to fit between the upper surface of the rails and a lowermost surface on the lower or "boot" flange on the gate assembly.

Designing a railcar discharge gate assemblies with an overall reduced height which allows use of a portable unloading sled would appear relatively simple until a closer examination of such a drastic design change is carefully and fully analyzed. Changing the geometry of the railcar discharge gate results in a gate assembly having a discharge opening and "boot flange" which is too large for standard unloading boots. In other words, as the overall height of the gate assembly is shortened, the overall size of the discharge opening of the gate assembly gets bigger to a point whereat it is too large for standard unloading boots.

For example, railroad hopper car discharge gate assemblies have been designed with an overall height of about 7.0 inches so as to allow a portable unloading sled to fit between the top or upper surface of the rails and the underside of the "boot flange" on the railcar discharge gate assembly. The "boot flange" opening on one such exemplary gate, however, measures about 26.5 inches by 56 inches or about 1484 square inches. The "boot flange" opening on another of such exemplary gates measures about 25.25 inches by about 59 inches or about 1490 square inches. In either example, the "boot flange" opening on the gate assembly is simply too large for the standard nominal 13 inch by 42 inch unloading boot (having outside dimensions of about 19 inches by 48 inches) to adequately seal therewith and thereagainst. As a result, and when such gate assemblies are used in operable combination with the standard 13 inch by 42 inch boot, commodity being discharge from the railcar readily spills outside of the boot and is lost—a result not viewed favorably by the customer.

To further complicate the gate assembly design, the Association of American Railroads (the "AAR"), revised the Standard governing locking systems for gate assemblies used on hopper-type railroad cars. The revised Standard (S-233-2011) requires the locking/unlocking or latching/unlatching functions for the gate assembly to be integrated into the discharge gate operating mechanism. As such, rotation of a capstan in a direction to open the gate must first unlock or unlatch the gate and then move the gate from the closed position to the open position.

Thus, there is a continuing need and desire for a railcar discharge gate assembly offering adequate clearance beneath the car and which can be used with a conventional portable unloading sled and has an opening through which commodity passes which also allows use with a standard unloading boot and, more specifically, the size boots used in 13 inch by 42 inch outlet gates while satisfying the latest AAR Standard.

SUMMARY

In accordance with one aspect, there is provided a low profile discharge gate assembly for a railroad hopper car discharge gate assembly that includes a rigid frame including a pair of side frame members rigidly joined to a pair of end frame members in a generally rectangular design and defining a discharge opening through which commodity is adapted to gravitationally pass. The frame includes a plurality of supports extending in generally parallel relation relative to each other and between the end frame members. A gate is supported on the plurality of spaced supports for linear movement in a single generally horizontal path of travel between a closed position, wherein the gate prevents a flow of commodity through the discharge opening, and an open position. Each side frame member and each end frame member includes an upper outwardly extending flange. The upper flanges on the side frame members and end frame members are arranged above an upper surface of the gate and in generally coplanar relation relative to each other. Each side frame member and each end frame member has a horizontally slanted wall extending downwardly and away from the respective upper flange on each side frame member and each end frame member and inwardly toward the discharge opening so as to define an included angle of less than 30 degrees relative to a horizontal plane defined by the coplanar relation of the upper flanges relative to each other.

In accordance with this aspect of the invention disclosure, the side frame members and the end frame members each include a lower outwardly extending flange. The lower flanges on the side frame members and end frame members are arranged below the upper surface of the gate and in generally coplanar relation relative to each other. A vertical distance of less than 7.5 inches separates a lowermost surface on the lower flange of the side frame member and end frame members from an upper surface on the upper flange of each side frame member and each end frame member whereby lending a low profile to the gate assembly.

The gate assembly further includes structure carried by the side frame members and at least one of the end frame members. Such structure is disposed between the lower flanges on the side frame members and the at least one of the end frame members and the gate. Such structure includes a series of horizontally slanted surfaces or baffles extending inwardly from at least three sides of the discharge opening for restricting commodity flow passing from the gate assembly discharge opening.

In one form, the surfaces on the structure carried by the frame members and disposed between the lower flanges on the side frame members and at least one end frame member of the gate assembly are horizontally slanted at an angle preferably ranging between about 25 degrees and less than 45 degrees relative to a horizontal plane. Moreover, the structure carried by the frame members and disposed between the lower flanges on the side frame members and at least one end frame member of the gate assembly is preferably formed integral with the side frame members and at least one end frame member of the gate assembly.

To selectively move the gate between positions, an operating shaft assembly is provided for rotation about a fixed axis. The operating shaft assembly includes an elongated shaft operably coupled to the gate. Preferably, seal structure is arranged in sealing engagement with the upper surface of and toward a periphery of the gate. A lock assembly is also preferably provided for preventing inadvertent movement of the gate toward the open position. In one form, the lock assembly is operable in timed relation relative to rotation of the operating shaft assembly for positively removing a stop from the path of travel of the gate prior to the gate being positively moved, under the influence of the operating shaft assembly, toward the open position.

Preferably, end of each gate support is secured to the end frame member disposed the furthest distance from the operating shaft assembly. In this embodiment, each support is secured to and extends through the opposed end frame member to allow a portion of the support to journal the shaft of the operating shaft assembly thereby limiting deflection of the shaft relative to the fixed axis when the shaft is rotated to move the gate toward the open position.

According to another aspect of the invention, there is provided a low profile discharge gate assembly for a railroad hopper car. In this embodiment, the low profile gate assembly includes a rigid frame having a pair of laterally spaced and generally parallel side frame members and a pair of longitudinally spaced and generally parallel end frame members fixed between the side frame members to define a discharge opening through which commodity is adapted to gravitationally pass. The frame includes a plurality of laterally spaced supports extending in generally parallel relation relative to each other and between the end frame members. A gate is supported on the plurality of supports for linear sliding movement along a single predetermined and generally horizontal path of travel between closed and open positions. The gate includes upper and lower generally parallel surfaces. In this embodiment, the side frame members and end frame members each include an upper outwardly extending flange, with the upper flanges on the side frame members and end frame members being arranged above the upper surface of the gate and in generally coplanar relation relative to each other. Each side frame member and end frame member further includes a horizontally slanted wall extending downwardly and away from the respective upper flange on each side frame member and each end frame member and inwardly toward the discharge opening to define an included angle of less than 30 degrees relative to a horizontal plane defined by the coplanar relation of the upper flanges relative to each other. According to this aspect of the invention disclosure, each frame member further includes a depending wall extending generally perpendicular to the upper flange of each frame member. Each depending wall is joined above the upper surface of the gate to a terminal edge of the respective horizontally slanted wall of the frame members an extends below the lower surface of the gate.

According to this aspect of the invention disclosure, each side frame member and each end frame member further includes a lower outwardly extending flange, with the lower flanges on the side frame members and end frame members being arranged below the upper surface of the gate and in generally coplanar relation relative to each other. A vertical distance of less than 7.5 inches separates a lowermost surface on the lower flange of each side frame member and each end frame member from an upper surface on the upper flange of each side frame member and each end frame member whereby yielding a low profile to the gate assembly.

This embodiment of a low profile gate assembly further includes structure carried by both side frame members and one of the end frame members and disposed between the lower flanges on the side frame members and the one end frame member and the gate. Such structure includes a series of horizontally slanted surfaces extending inwardly from and joining the depending wall structure of both side frame members and the one end frame member so as to restrict commodity flow passing from the gate assembly.

In a preferred embodiment, the surfaces on the structure carried by the frame members and disposed between the lower flanges on the side frame members and at least one end frame member of the gate assembly are horizontally slanted at an angle preferably ranging between about 25 degrees and about 45 degrees relative to a horizontal plane. The structure carried by the frame members and disposed between the lower flanges on the side frame members and at least one end frame member of the gate assembly is preferably formed integral with the side frame members and at least one end frame member of the gate assembly.

An operating shaft assembly is provided for selectively moving the gate between positions and relative to the discharge opening of the gate assembly. The operating shaft assembly includes an elongated operating shaft preferably supported by extensions of the side frame members for rotation about a fixed axis. Seal structure is preferably arranged in sealing engagement with the upper surface of and toward a periphery of the gate.

A lock assembly is provided for inhibiting inadvertent movement of the gate toward the open position. The lock assembly is preferably operable in timed relation relative to rotation of the operating shaft assembly for positively removing a stop from the path of travel of the gate prior to movement of the gate from the closed position toward the open position. In one form, the stop of the lock assembly, when the gate is in the closed position, positively engages with the gate thereby preventing inadvertent movement of the gate toward the open position. A mechanical system is preferably provided between the lock assembly stop and the operating shaft assembly for positively displacing the stop from engagement with the gate upon rotation of the operating shaft assembly and prior to movement of the gate toward the open position. In one embodiment, the mechanical system includes a lost motion mechanism which collapses upon rotation of the operating shaft assembly in a direction to move the gate toward the open position whereafter the operating shaft assembly is operably coupled to the gate.

In a preferred form, one end of each support for the gate is secured to the end frame member disposed the furthest distance from the operating shaft assembly. Each support is preferably secured to and extends through the opposed end frame member to allow a portion of the support to journal the shaft of the operating shaft assembly thereby limiting deflection of the shaft relative to the fixed axis when the shaft is rotated to move the gate toward the open position.

According to another family of embodiments, there is provided a low profile discharge gate assembly adapted to be secured in material receiving relation relative to a standard opening defined toward a bottom of a railroad hopper car. The discharge gate assembly includes a rigid frame having a pair of laterally spaced and generally parallel side frame members and first and second longitudinally spaced and generally parallel end frame members fixed between the side frame members so as to define a ledgeless discharge opening for the gate assembly through which commodity is adapted to pass. The frame also includes a plurality of laterally spaced supports extending in generally parallel relation relative to each other and between the end frame members. A gate is supported on the plurality of supports for linear sliding movement along a single predetermined and generally horizontal path of travel between closed and open positions. The gate includes upper and lower generally parallel surfaces.

In this embodiment, the side frame members and end frame members each include an upper outwardly extending flange, with the upper flanges on the side frame members and end frame members are arranged above the upper surface of the gate and in generally coplanar relation relative to each other. The upper flanges on the side frame members and end frame members define a bolting pattern generally corresponding to a standard bolting pattern surrounding a standard opening toward the bottom of the railroad hopper car whereby facilitating securement of the gate assembly to the hopper car. The side frame members and end frame members each has a horizontally slanted wall extending downwardly and away from the respective upper flange on each side frame member and each end frame member and inwardly toward the ledgeless discharge opening so as to define an included angle of less than 30 degrees relative to a horizontal plane defined by the coplanar relation of the upper flanges relative to each other. Also, each side frame member and each end frame member has a depending wall extending generally perpendicular to the upper flange on each frame member and below the lower surface of the gate. The second frame member is configured to allow the gate to extend therethrough.

In this embodiment, each side frame member and each end frame member further includes a lower flange extending generally parallel to the upper flange. The lower flanges on the side frame members and end frame members is arranged below the lower surface of the gate and in generally coplanar relation relative to each other. A vertical distance of less than 7.5 inches separates a lowermost surface on the lower flange of each side frame member and each end frame member from an upper surface on the upper flange of each side frame member and each end frame member whereby yielding a low profile to the gate assembly.

The gate assembly further includes structure carried by both side frame members and the second end frame member and disposed between the lower flanges on the frame members and at least one of the end frame members and the lower surface of the gate. Such structure includes a series of horizontally slanted surfaces extending inwardly from a terminal edge of and joining the respective depending wall of both side frame members and the second end frame member with the respective lower flange below the lower surface of the gate such that the gate assembly defines another discharge opening disposed beneath the ledgeless discharge opening. This second discharge opening defined by the gate assembly is sized to restrict commodity flow passing from the ledgeless discharge opening of the gate assembly.

Preferably, the slanted surfaces on the structure carried by the frame members and disposed between the lower flanges on the side frame members and one end frame member of the gate assembly are horizontally slanted at an angle ranging between about degrees and about 45 degrees relative to a horizontal plane. The structure carried by the frame members and disposed between the lower flanges of the gate assembly is preferably formed integral with the side frame members and the second end frame member of the gate assembly.

An operating shaft assembly is supported by extensions of the side frame members for rotation about a fixed axis. The operating shaft assembly includes an elongated operating shaft which is operably coupled to said the gate through pinions mounted on the shaft. Preferably, the operating shaft assembly extends transversely across the predetermined path of travel of the gate and includes capstans arranged at opposite ends thereof. The capstans are disposed for engagement from either side of the gate assembly. Moreover, the gate assembly includes seal structure arranged in sealing engagement with a periphery of the gate.

In a preferred embodiment, the plurality of laterally spaced supports includes a first support extending generally along an axis of the gate assembly in parallel relation relative to the direction in which the gate moves along with second and third supports disposed to opposed lateral sides of the first support. In one form, an upper surface of each support is provided with material for enhancing the ability of the gate to slide thereacross as the gate moves between closed and open positions. One end of each support is preferably secured to the end frame member disposed the furthest distance from the operating shaft assembly. In one form, each support extends through the opposed end frame member to allow a portion of the support to journal the shaft of the operating shaft assembly thereby limiting deflection of the shaft relative to the fixed axis when the shaft is rotated to move the gate.

A lock assembly is provided on the gate assembly for inhibiting inadvertent movement of the gate toward the open position. The lock assembly is preferably operable in timed relation relative to rotation of the operating shaft assembly. Preferably, the lock assembly includes a stop which, when the gate is in the closed position, positively engages with the gate thereby preventing inadvertent movement of the gate toward an open position and which is operably removed from the path of travel of the gate prior to the gate being positively moved toward the open position under the influence of the operating shaft assembly.

A mechanical system is preferably provided between the lock assembly stop and the operating shaft assembly for positively displacing the stop from engagement with the gate upon rotation of the operating shaft assembly and prior to movement of the gate toward the open position. The mechanical system includes a lost motion mechanism which collapses upon rotation of the operating shaft assembly in a direction to move the gate toward the open position whereafter the operating shaft assembly is operably coupled to the gate.

Another aspect of this invention disclosure relates to a low profile discharge gate assembly for a railroad hopper car discharge gate assembly including a rigid frame having a pair of laterally spaced and generally parallel side frame members along with first and second longitudinally spaced and generally parallel end frame members fixed between the side frame members. The frame of the gate assembly defines a first discharge opening having a cross-sectional area of about 100 square inches, and with the frame including a plurality of laterally spaced supports extending in generally parallel relation relative to each other and between the end frame members. A gate is supported on the supports for linear sliding movement along a single predetermined and generally horizontal path of travel between closed and open positions. The side frame members and end frame members each include an upper outwardly extending flange, with the upper flanges on the side frame members and end frame members being arranged above an upper surface of the gate and in generally coplanar relation relative to each other and define a 13 by 42 bolting pattern. Each side frame member and end frame member includes a horizontally slanted wall extending downwardly and away from the respective upper flange on each side frame member and each end frame member and inwardly toward the discharge opening so as to define an included angle of less than 30 degrees relative to a horizontal plane defined by the coplanar relation of the upper flanges relative to each other. Each side frame member and each end frame member further includes a depending wall extending generally perpendicular to the upper flange of each frame member. Each depending wall is joined above the upper surface of the gate to a terminal edge of the horizontally slanted wall of the respective frame members and extends below the lower surface of the gate. In this embodiment, the second end frame member is configured to allow the gate to extend therethrough.

In this embodiment, each frame member further includes a lower outwardly extending flange. The lower flanges on the side frame members and end frame members are arranged below a lower surface of the gate and in generally coplanar relation relative to each other. A vertical distance of less than 7.5 inches separates a lowermost surface on the lower flange of each side frame member and each end frame member from an upper surface on the upper flange of each side frame member and each end frame member whereby yielding a low profile to the gate assembly.

The gate assembly further includes structure carried by the both the side frame members and the second end frame member. Such structure is disposed between the lower flanges on the side frame members and the second end frame member and the lower surface of the gate. In this embodiment, such structure includes a series of horizontally slanted surfaces extending inwardly from and joining the depending wall structure of both side frame members and the second end frame member with the lower outwardly extending flanges thereon such that the gate assembly defines a second discharge opening disposed beneath the first discharge opening. The second discharge opening of the gate assembly has a cross-sectional area sized between about 25% and about 35% smaller than the cross-sectional size of the first discharge opening of the gate assembly so as to restrict flow of commodity from the gate assembly. In this embodiment, the horizontally extending surfaces of said structure on the two side frame members and the second end frame member are joined to the respective depending wall below and in spaced relation with the lower surface of the gate.

In this family of embodiments, seal structure is arranged in sealing engagement with the upper surface of and toward a periphery of the gate. The gate assembly furthermore preferably includes an operating shaft assembly supported by extensions of the side frame members for rotation about a fixed axis and is operably coupled to the gate. Preferably, a lock assembly is also provided for inhibiting inadvertent movement of the gate toward the open position.

The slanted surfaces on the structure carried by the frame members and disposed between the lower flanges on the side frame members and the second end frame member and the lower surface of the gate are horizontally slanted preferably at an angle ranging between about 25 degrees and about 45 degrees such that the commodity can gravitationally pass from the gate assembly while minimizing the vertical height of the gate assembly. Preferably, the slanted surfaces on the structure carried by the frame members and disposed between the lower flanges on the side frame members and the second end frame member and the gate are horizontally slanted at an angle between about 25.5 degrees and about 29.5 degrees relative to a horizontal plane. In one embodiment, the structure carried by the frame members and disposed between the lower flanges on the side frame members and at least one end frame member and the gate is formed integral with the side frame members and at least one end frame member of the gate assembly.

Preferably, the operating shaft assembly is operably coupled to the gate through pinions mounted on a shaft rotatable about the fixed axis. The pinions are preferably arranged in intermeshing relation with racks carried on the gate assembly frame. The shaft of the operating shaft assembly preferably extends transversely across the predetermined path of travel of the gate and includes capstans or operating handles arranged at opposite ends thereof. The capstans or operating handles are disposed for engagement from either side of the gate assembly.

In this embodiment, the plurality of laterally spaced supports for said gate includes a first support preferably generally centralized relative to the discharge opening of the gate assembly and second and third supports disposed to opposed lateral sides of the first support member. An upper surface of each support is preferably provided with material for enhancing the ability of the gate to slide thereacross as the gate moves between the closed and open positions. One end of each support is secured to the end frame member disposed the furthest distance from the operating shaft assembly. According to this embodiment, each support is secured to and extends through the opposed end frame member. Also, each support is preferably structured to guide and support the shaft of the operating shaft assembly thereby limiting deflection of the shaft relative to the fixed axis when the shaft is rotated to move the gate toward the open position.

Preferably, the lock assembly is operable in timed relation relative to rotation of the operating shaft assembly. The lock assembly includes a stop which, when the gate is in the closed position, positively engages with the gate thereby preventing inadvertent movement of the gate toward the open position and which is operably removed from the path of travel of the gate prior to the gate being positively moved toward the open position under the influence of the operating shaft assembly.

A mechanical system is preferably provided between the lock assembly stop and the operating shaft assembly for positively displacing the stop from engagement with the gate prior to movement of the gate toward the open position. In a preferred form, the mechanical system for the lock assembly includes cam structure disposed adjacent to the extension of at least one of the side frame members to minimize the effect high torque requirements imparted to the operating shaft assembly have on operation of the lock assembly. The mechanical system preferably includes a lost motion mechanism which collapses upon rotation of the operating shaft assembly in a direction to move the gate toward the open position whereafter the operating shaft assembly is operably coupled to the gate.

In another family of embodiments, there is provided a railroad hopper car discharge gate assembly including a rigid frame with a pair of side frame members rigidly joined to a pair of end frame members in a generally rectangular design and defining a discharge opening through which commodity is adapted to gravitationally pass. The gate assembly frame includes a plurality of laterally spaced supports extending in generally parallel relation relative to each other and between the end frame members. A gate is slidably movable on the supports. The gate is arranged for linear movement in a single generally horizontal path of travel between a closed position, wherein the gate prevents a flow of commodity through the discharge opening, and an open position. Each side frame member and each end frame member includes an upper outwardly extending flange. The upper flanges on the side frame members and end frame members are arranged above an upper surface on the gate and in generally coplanar relation relative to each other. Moreover, each side frame member and each end frame member has a horizontally slanted wall extending downwardly and away from the respective upper flange on each side frame member and each end frame member and inwardly toward the discharge opening. Each side frame member and each end frame member furthermore has a wall depending from a terminal end of the respective slanted wall on the frame members. Seal structure is arranged in sealing engagement with the upper surface of and toward a periphery of the gate is carried by the end frame members and side frame members. Also, an operating shaft assembly is supported by extensions of the side frame members for rotation about a fixed axis extending generally parallel to and adjacent to one of the end frame members on the rigid frame. The operating shaft assembly includes an elongated shaft which rotates about the fixed axis and is operably coupled to the gate. A lock assembly is provided for inhibiting inadvertent movement of the gate toward the open position.

According to this aspect of the invention disclosure, each support for the gate is secured at one end to the end frame member disposed the furthest distance from the operating shaft assembly and extends lengthwise through the other end frame member. An opposite end of each support extends endwise through the end frame member. The shaft of the operating shaft assembly extends through and is guided and supported by the opposed end of each support so as to limit deflection of the shaft relative to the fixed axis when the shaft is rotated to move the gate toward the open position.

In one form, the plurality of supports includes a generally centralized support extending along an axis of the gate assembly in generally parallel relation relative to the direction in which the gate moves between the closed and open positions along with an additional supports disposed to opposed lateral sides of and extending generally parallel to the generally centralized support. In a preferred embodiment, an upper surface of the generally centralized support is provided with material for enhancing the ability of the gate to slide thereacross as the gate moves between closed and open positions. Each support for guiding and supporting the shaft includes a closed marginal bore through which the shaft of the operating shaft assembly extends.

According to still another aspect of this invention disclosure there is provided a gate assembly for a railroad hopper car including a rigid frame including a pair of side frame members rigidly joined to first and second end frame members in a generally rectangular design and defining a discharge opening through which commodity is adapted to gravitationally pass. The frame includes a plurality of laterally spaced supports extending in generally parallel relation relative to each other and between said end frame members. A gate is supported on the plurality of spaced supports for linear movement in a single generally horizontal path of travel between a closed position, wherein the gate prevents a flow of commodity through the discharge opening, and an open position.

Each frame member includes an upper outwardly extending flange, with the upper flanges on the frame members being arranged above an upper surface of the gate and in generally coplanar relation relative to each other. The frame member members each have a horizontally slanted wall extending downwardly and away from the respective upper flange on the frame member and inwardly toward the discharge opening so as to define an acute angle relative to a horizontal plane defined by the coplanar relation of the upper flange relative to each other. Each frame member further includes a generally vertical wall joined to and extending generally perpendicular to the upper flange of each frame member, and with each depending wall being joined above the upper surface of said gate to a terminal edge of the respective horizontally slanted wall of the frame members and extends below the lower surface of said gate. The second end frame member is configured to accommodate passage of the gate therethrough. Each side frame member and each end frame member furthermore includes a lower outwardly extending flange. The lower flanges on the side frame members and end frame members are arranged below the lower surface of the gate and in generally coplanar relation relative to each other.

The gate assembly according to this aspect of the invention disclosure also includes structure carried by the side frame members and the second end frame member for restricting commodity flow passing from the discharge opening of the gate assembly. Such structure includes a series of horizontally slanted surfaces extending inwardly from and joining the generally vertical wall and the lower flanges of each of the side frame members and the second end frame member. The horizontally slanted surfaces of such structure on the two side frame members and the second end frame member are joined to the respective generally vertical wall below and in spaced relation with the lower surface of the gate.

Seal structure is arranged in sealing engagement with the upper surface of and toward a periphery of the gate. Also, an operating shaft assembly is supported by extensions of the side frame members for rotation about a fixed axis. The operating shaft assembly is operably coupled to the gate. Also, a lock assembly is provided in combination with the gate assembly for inhibiting inadvertent movement of the gate toward the open position.

Preferably, the structure carried by the frame members and disposed between the lower flanges on the side frame members and the second end frame member is formed integral with the side frame members and the second end frame member of the gate assembly. In a preferred form, the operating shaft assembly is operably coupled to the gate through pinions mounted on a shaft rotatable about said fixed axis, with said pinions being arranged in intermeshing relation with racks carried on said gate.

In this embodiment, the shaft of the operating shaft assembly extends transversely across the predetermined path of travel of said gate and includes capstans arranged at opposite ends thereof, said capstans being disposed for engagement from either side of said gate assembly. Moreover, the plurality of laterally spaced supports preferably includes a first support extending generally along an axis of said gate assembly in parallel relation relative to the direction in which said gate moves between the closed and open positions along with second and third supports disposed to opposed lateral sides of said first support. An upper surface of each support is preferably provided with material for enhancing the ability of the gate to slide thereacross as the gate moves between closed and open positions.

In a preferred form, one end of each support is secured to the end frame member disposed the furthest distance from said operating shaft assembly. Each support preferably extends through an opposed end frame member to allow a portion of the support to guide and support the shaft of the operating shaft assembly thereby limiting deflection of the shaft relative to the fixed axis when the shaft is rotated to move the gate toward the open position. The lock assembly is operable in timed relation relative to rotation of said operating shaft assembly for positively removing a stop from the path of travel of the gate prior to movement of the gate from the closed position toward the open position. In this embodiment, the stop of the lock assembly, when the gate is in the closed position, positively engages with the gate thereby preventing inadvertent movement of the gate toward an open position.

A mechanical system is preferably provided between the stop of the lock assembly and the operating shaft assembly. The mechanical system preferably includes a lost motion mechanism which collapses upon rotation of the operating shaft assembly in a direction to move the gate toward the open position whereafter the operating shaft assembly is operably coupled to the gate. The mechanical system preferably includes cam structure disposed adjacent to the extension of at least one of said side frame members to minimize the effect high torque requirements imparted to the operating shaft assembly have on operation of the lock assembly. Preferably, the mechanical system includes a lost motion mechanism which collapses upon rotation of the operating shaft assembly in a direction to move the gate toward the open position whereafter the operating shaft assembly is operably coupled to said gate.

DESCRIPTION OF THE DRAWINGS

FIG. 15 is a fragmentary side view similar to FIG. 12 but showing the relationship of the components of the gate assembly as the operating shaft assembly is rotated to move the gate toward an open position;

FIG. 16 is a fragmentary sectional side view showing the relationship of various component parts of the present invention when the operating shaft assembly is rotated to the position shown in FIG. 15;

DETAILED DESCRIPTION OF THE PRESENT INVENTION

Figure 1:
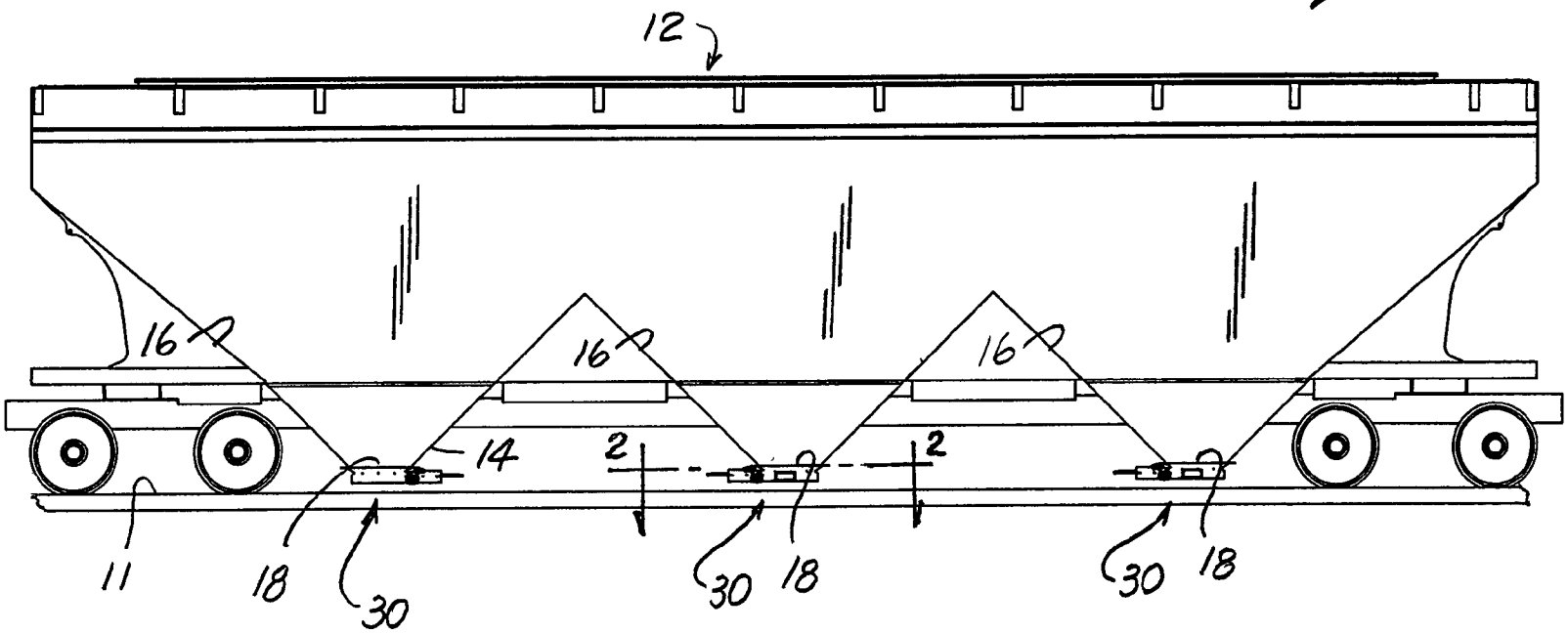
FIG. 1 is side elevational view of a railroad hopper car having mounted thereon a series of gate assemblies which embody one form of the present invention disclosure.

While the present invention is susceptible of embodiment in multiple forms, there is shown in the drawings and will hereinafter be described a preferred embodiment of the invention disclosure, with the understanding the present disclosure sets forth an exemplification of the invention which is not intended to limit the invention disclosure to the specific embodiment illustrated and described.

Referring now to the drawings, wherein like reference numerals indicate like parts throughout the several views, schematically shown in FIG. 1 is a railroad hopper car, generally indicated by numeral 10 and which is movable between locations over conventional rails 11. Although railroad hopper-type cars have a variety of configurations, they generally have a walled enclosure or hopper 12 for storing and transporting commodity therewithin. A bottom 14 of car 10 can also take a variety of configurations. Suffice it to say, in the exemplary embodiment, the bottom 14 of the enclosed hopper 12 is provided with a plurality of longitudinally spaced funnel shaped chutes 16 between opposed ends of the hopper 12.

Figure 4:
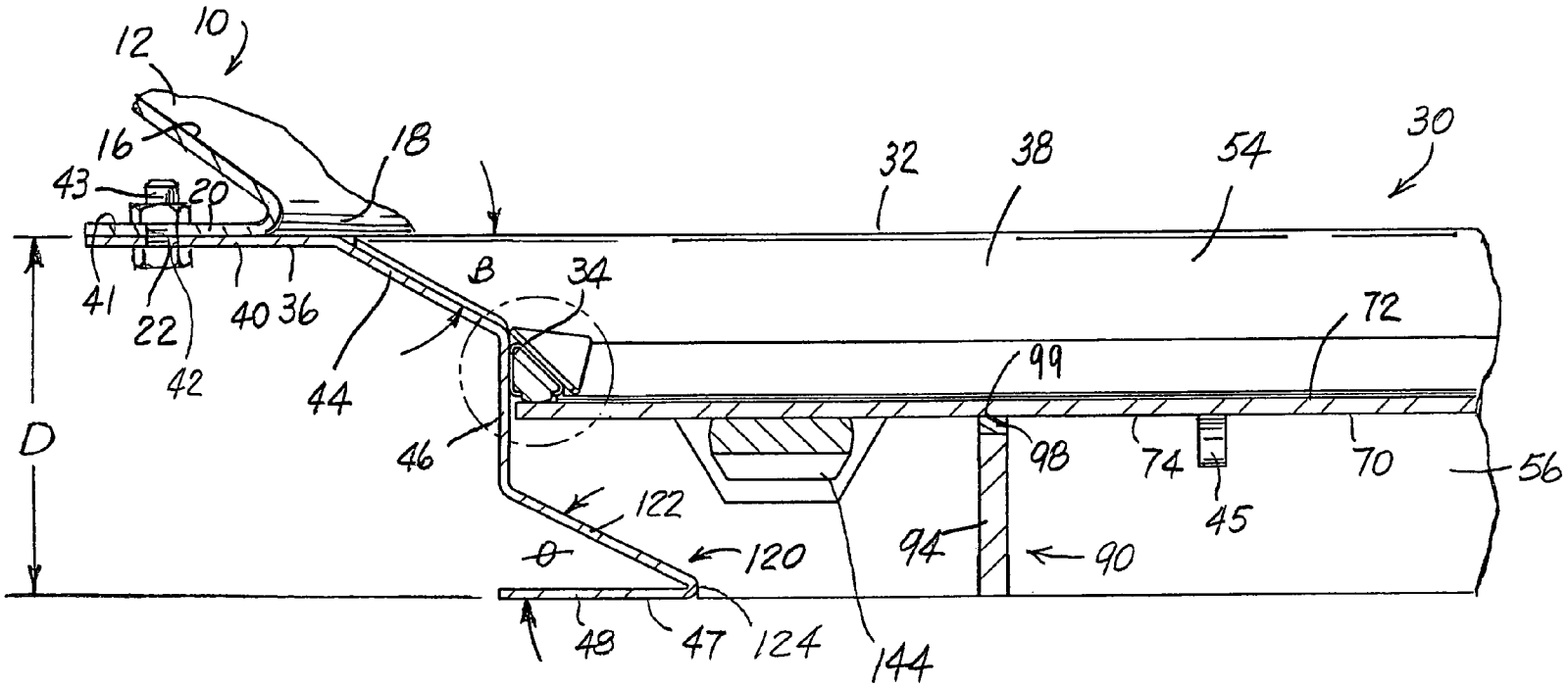
FIG. 4 is an enlarged sectional view taken along line 4-4 of FIG. 2.
Figure 5:
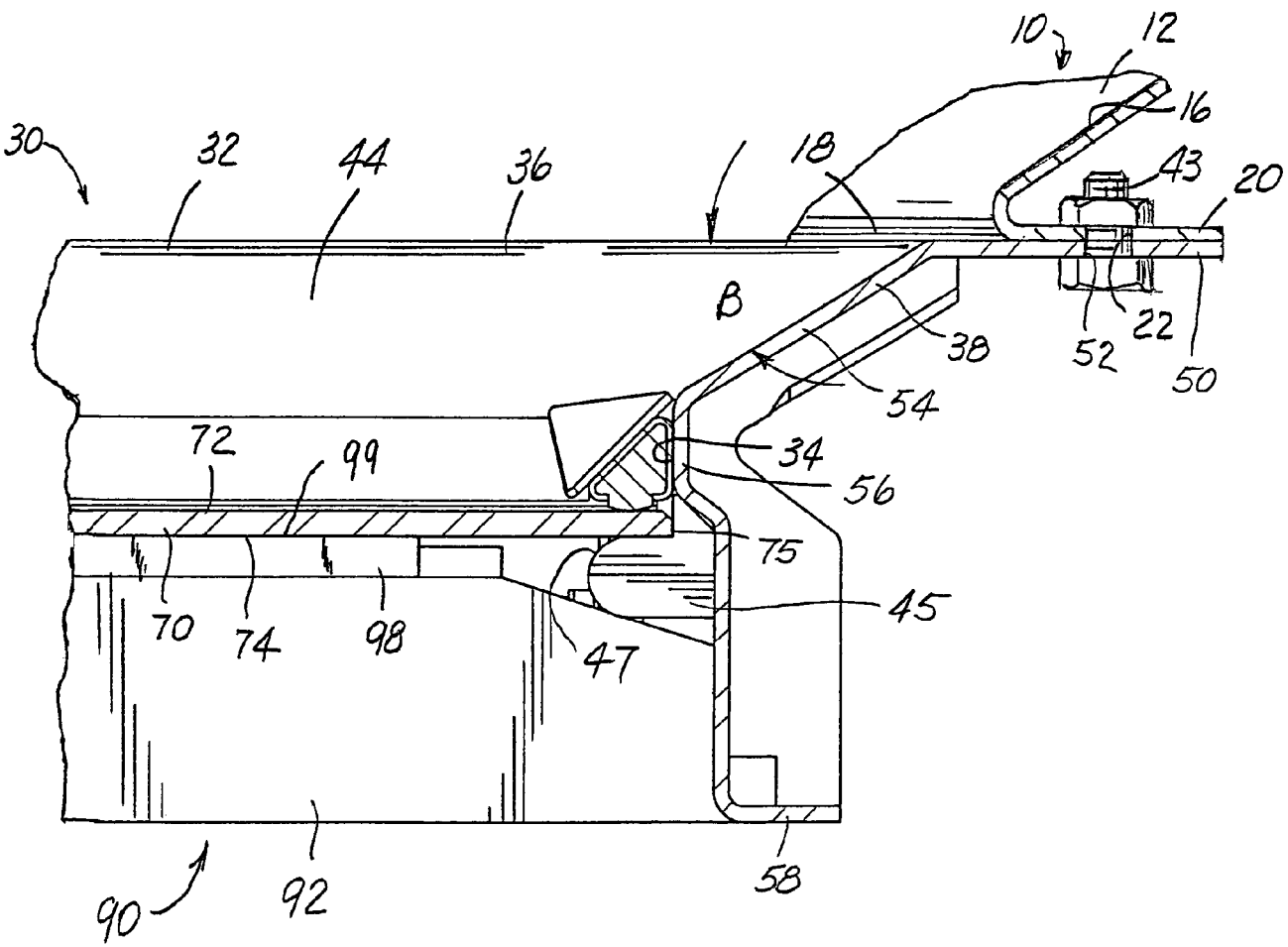
FIG. 5 is an enlarged sectional view taken along line 5-5 of FIG. 2.

As shown in FIG. 1, each hopper chute 16 has a standard opening 18 through which commodity is gravitationally discharged from car 10. Moreover, and as shown in FIGS. 4 and 5, hopper 12 is provided with a mounting flange 20 extending outwardly from and arranged about the standard opening 18 on hopper 12. Typically, flange 20 defines a series of side-by-side openings or holes 22 which combine to define a standard bolting pattern on the mounting flange 20. In the illustrated embodiment, the side-by-side openings or holes 22 combine to define a conventional 13 by 42 bolting pattern.

According to the present invention, a low profile discharge gate assembly 30 is arranged in material receiving relation relative to each standard opening 18 on the hopper 12 to control the discharge of commodity from the railcar 10. Each gate assembly 30 on the railcar is substantially similar, thus, only one gate assembly will be described in detail.

Figure 2:
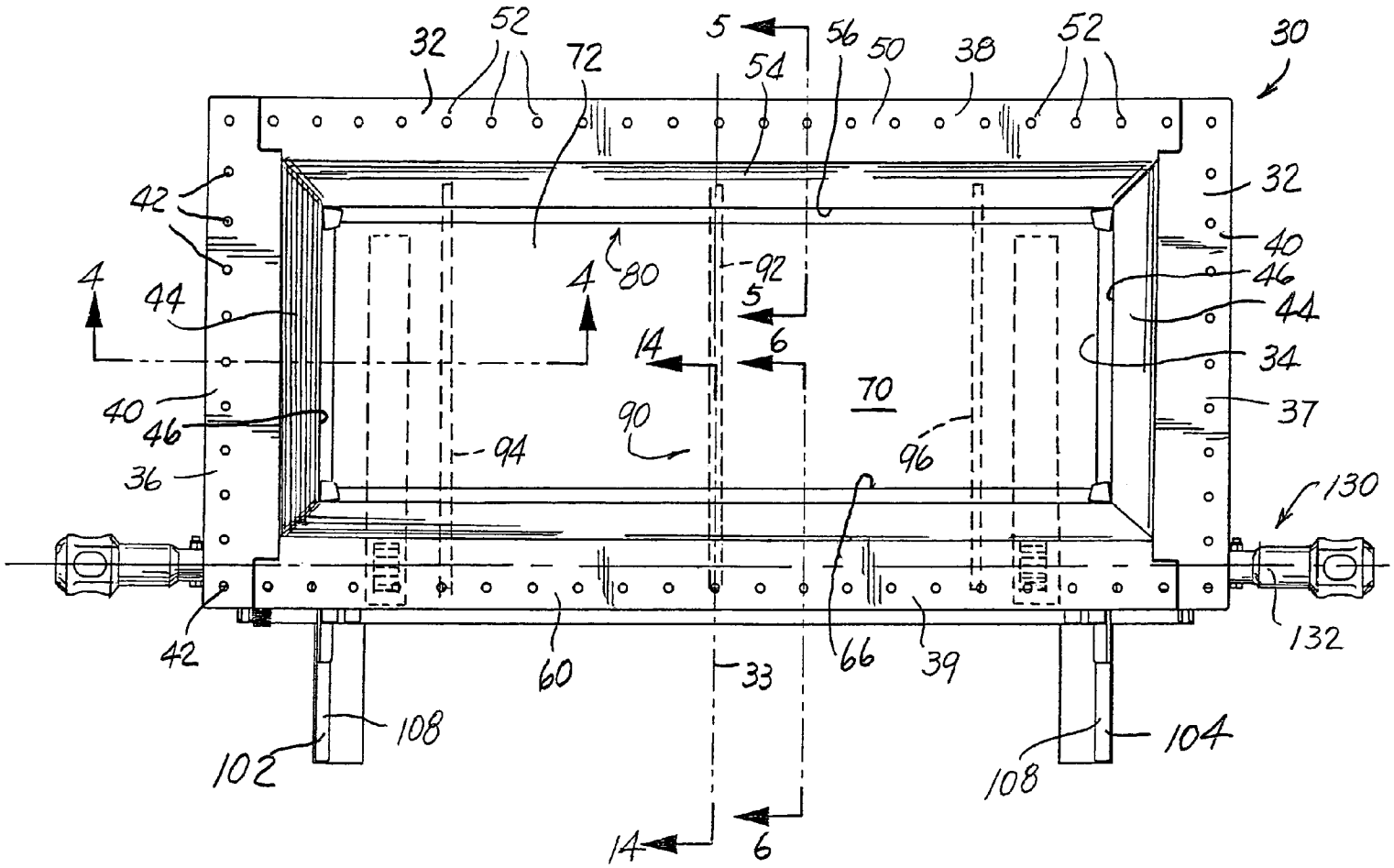
FIG. 2 is an enlarged sectional view taken along line 2-2 of FIG. 1.
Figure 3:
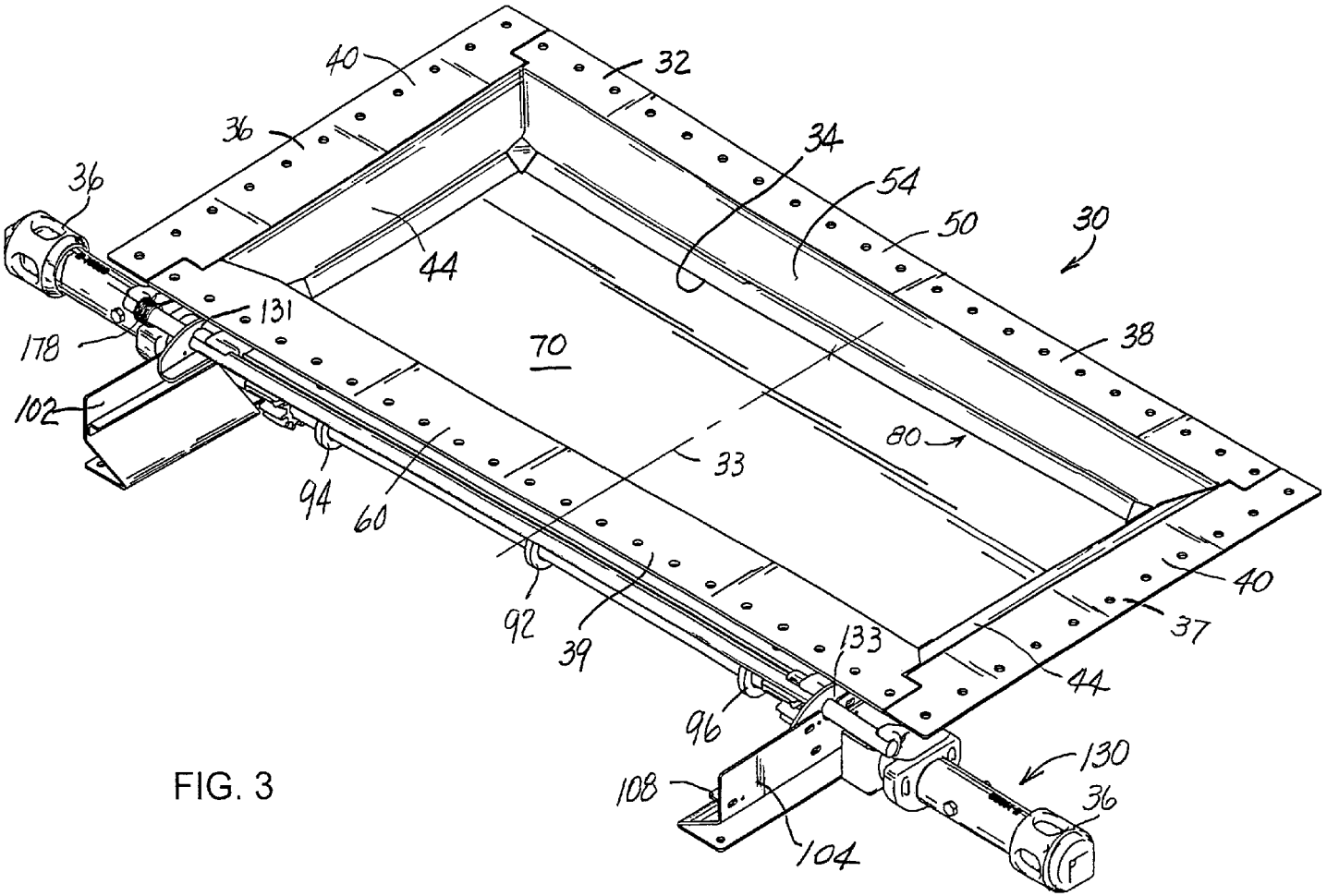
FIG. 3 is perspective view of the gate assembly illustrated in FIG. 2.

As shown in FIGS. 2 and 3, each gate assembly 30 includes a rigid frame 32 having an axis 33 and defining a discharge opening 34. Gate assembly 30 also includes a gate 70 which, as discussed below, is selectively movable between a closed position, wherein commodity is prevented from passing through the discharge opening 34, and an open position. Gate 70 moves in a single generally horizontal path of travel so as to control the gravitational discharge of commodity from the hopper 12 (FIG. 1). The gate assembly frame 32 is formed of a pair of generally parallel metal side frame members 36, 37 and a pair of generally parallel metal end frame members 38, 39 rigidly fixed between the side frame members 36, 37. In one form, the side frame members 36, 37 are configured as mirror images of each other. Accordingly, only side frame member 36 will be discussed in detail.

As shown in FIGS. 2 and 4, each side frame member of gate assembly 30 includes an upper outwardly extending and rigid and generally planar mounting flange 40 arranged above an upper surface 72 of the gate 70 and defining a series of side-by-side openings or holes 42 so as to allow a shank portion of a threaded fastener 43 to extend therethrough whereby securing the gate assembly 30 to the conventional mounting flanges 20 on the bottom of the railcar hopper 12. As further illustrated in FIG. 4, each side frame member of gate assembly 30 further includes a horizontally slanted generally planar wall 44 extending downwardly and away from the respective upper mounting flange 40 on each side frame member and inwardly toward the discharge opening 34 for the gate assembly 30.

In the illustrated embodiment, the horizontally slanted wall 44 of each side frame member contributes to the low profile design of the gate assembly 30. That is, the slanted wall 44 of each side frame member extends inwardly toward the discharge opening 34 and at angle β relative to a horizontal plane defined by the upper mounting flange 40 on each side member of the discharge gate assembly 30. In one form, the slanted wall 44 of each side frame member extends inwardly toward the discharge opening 34 and at angle of less than 30 degrees relative to a horizontal plane defined by the upper mounting flange 40 on each side member of the discharge gate assembly 30. In a most preferred form, the slanted wall 44 of each side frame member extends inwardly toward the discharge opening 34 and at angle ranging between about 26.5 degrees and about 28 degrees.

In the embodiment shown in FIG. 4, each side frame member of gate assembly 30 also includes a depending wall 46 extending generally perpendicular to the upper flange 40 and rigidly joined toward and to a distal end of the horizontally slanted wall 44 of each side frame member. The depending wall 46 of each side frame member of gate assembly 30 extends from where it is joined to the horizontally slanted wall structure 44 above the upper surface 72 of gate 70 downwardly past a lower surface 74 of gate 70. Preferably, the depending wall 46 on each side member of the gate assembly 30 is formed integral with the mounting flange 40 and horizontally slanted wall 44 of each side frame member.

Also, and to add rigidity and strength thereto, and in the embodiment illustrated in FIG. 4, each side frame member of the discharge gate assembly 30 further includes a boot flange 48 disposed toward the lower end of and extending outwardly and away from the depending wall structure 46. As known, the boot flange 48 on each side frame member 36 and 37 facilitates an unloading sled (not shown) being abutted against the frame 32 of gate assembly 30 when material is to be discharged from car 10 (FIG. 1). As shown, the boot flange 48 of each side frame member on the gate assembly 30 is spaced from but extends in the same direction and in generally parallel relation with the respective mounting flange 40. Preferably, the mounting flange 40, the horizontally slanted wall 44, the depending wall structure 46 and the boot flange 48 are integrally formed with each other.

Preferably, an uppermost surface 41 of the mounting flange 40 and a lowermost surface 47 of the boot flange 48 of each side frame member of the gate assembly 30 are spaced apart by a distance D of less than 7.5 inches. In one form, the uppermost surface 41 of the mounting flange 40 and the lowermost surface 47 of the boot flange 48 of each side frame member of the gate assembly 30 are spaced apart by a distance D ranging between about 6.75 inches and about 7.0 inches. In a most preferred form, the uppermost surface 41 of the mounting flange 40 and the lowermost surface 47 of boot flange 48 of each side frame member of the gate assembly 30 are spaced apart by a distance of about 6.875 inches. This design provides the gate assembly 30 with a low profile while concurrently providing sufficient space between the lowermost boot flange surface 47 of the gate assembly 30 and an uppermost surface on the rails 11 so as to allow a conventional portable unloading sled (not shown) to be positioned in material receiving relation under the gate assembly 30 for unloading of the commodity from car 10 (FIG. 1).

In one form, the end frame member 38, at that end of gate assembly 30 which engages a transverse edge 75 of gate 70 when gate 70 is in a closed position, is designed slightly differently from end frame member 39. In the embodiment shown in FIGS. 2 and 5, end frame member 38 includes an upper outwardly extending, rigid and generally planar mounting flange 50 arranged above the upper surface 72 of gate 70 and defining a series of side-by-side openings or holes 52 to allow a shank portion of a threaded fastener 43 to extend therethrough whereby facilitating securement of gate assembly 30 to the conventional mounting flange 20 on the bottom of the railcar hopper 12 (FIG. 5). Notably, the upper mounting flange 50 of the end frame member 38 is arranged generally coplanar with the mounting flange 40 on each side frame member 36, 37.

As illustrated in FIG. 5, the end frame member 38 further includes a horizontally slanted generally planar wall 54 extending downwardly and away from the respective upper mounting flange 50 of end frame member 50 and inwardly toward the discharge opening 34 for the gate assembly 30. Like the slanted wall 44 on each side frame member 36 and 37, the slanted wall 54 of the end frame member 38 contributes to the low profile design of the gate assembly 30.

The slanted wall 54 on the end frame member 38 extends inwardly toward the discharge opening 34 and at angle β relative to a horizontal plane defined by the upper mounting flange 50 on the end frame member 38. In one form, the slanted wall 54 on the end frame member 38 extends inwardly toward the discharge opening 34 and at angle of less than 30 degrees relative to a horizontal plane defined by the upper mounting flange 50 on the end frame member 38. In a most preferred form, the slanted wall 54 on the end frame member 38 extends inwardly toward the discharge opening 34 and at angle ranging between about 26 and about 28 degrees. Suffice it to say, the slanted wall 54 on the end frame member 38 extends inwardly toward the discharge opening 34 and at angle β which is generally equal to the angle β defined between the slanted wall 44 of each side frame member 36, 37 of gate assembly 30.

In the embodiment shown in FIG. 5, the end frame member 38 further includes a depending wall 56 extending generally perpendicular to the upper flange 50 and rigidly joined toward and to a distal end of the horizontally slanted wall 54 of the end frame member 38. The depending wall 56 of end frame member 38 extends from where it is joined to the horizontally slanted wall structure 54 above the upper surface 72 of gate 70 downwardly past the lower surface 74 of gate 70. Preferably, the depending wall 56 on end frame member 38 is formed integral with the mounting flange 50 and the horizontally slanted wall 54.

Also, and to add rigidity and strength thereto, and in the embodiment shown in FIG. 5, the end frame member 38 further includes a boot flange 58 disposed toward the lower end of and extending outwardly and away from the depending wall 56. As known, the boot flange 58 on the end frame member 38 facilitates an unloading sled (not shown) being abutted against the frame 32 of gate assembly 30 when material is to be discharged from car 10 (FIG. 1). The boot flange 58 of the end frame member 38 is spaced from but extends in the same direction and in generally parallel relation with the respective mounting flange 50. Preferably, the mounting flange 50, the slanted wall 54, the depending wall 56, and the boot flange 58 are integrally formed with each other. Moreover, the boot flange 58 of the end frame member 38 is preferably arranged in generally coplanar relation relative to the boot flange 48 on the side frame members 36 and 37 of gate assembly 30. This design yields a gate assembly having a low profile while concurrently providing sufficient space between the boot flanges of gate assembly 30 and an uppermost surface on the rails 11 (FIG. 1) so as to allow a conventional portable unloading sled (not shown) to be positioned in material receiving relation under the gate assembly 30 for unloading of the commodity from car 10.

As shown in FIG. 5, the end wall 38 of gate assembly 30 is furthermore preferably provided with a series of laterally spaced supports 45 (with only one being shown in FIG. 5 for exemplary purposes) secured thereto. The supports 45 are arranged across the depending wall 56 of the end frame member 38 and serve to engage with and support the gate end 75 as gate 70 approaches a closed position relative to the discharge opening 34. Preferably, each support 45 is provided with a camming surface 47 for facilitating vertical positioning of the end 75 of gate 70 in the closed position relative to the discharge opening 34 of gate assembly 30.

Figure 6:
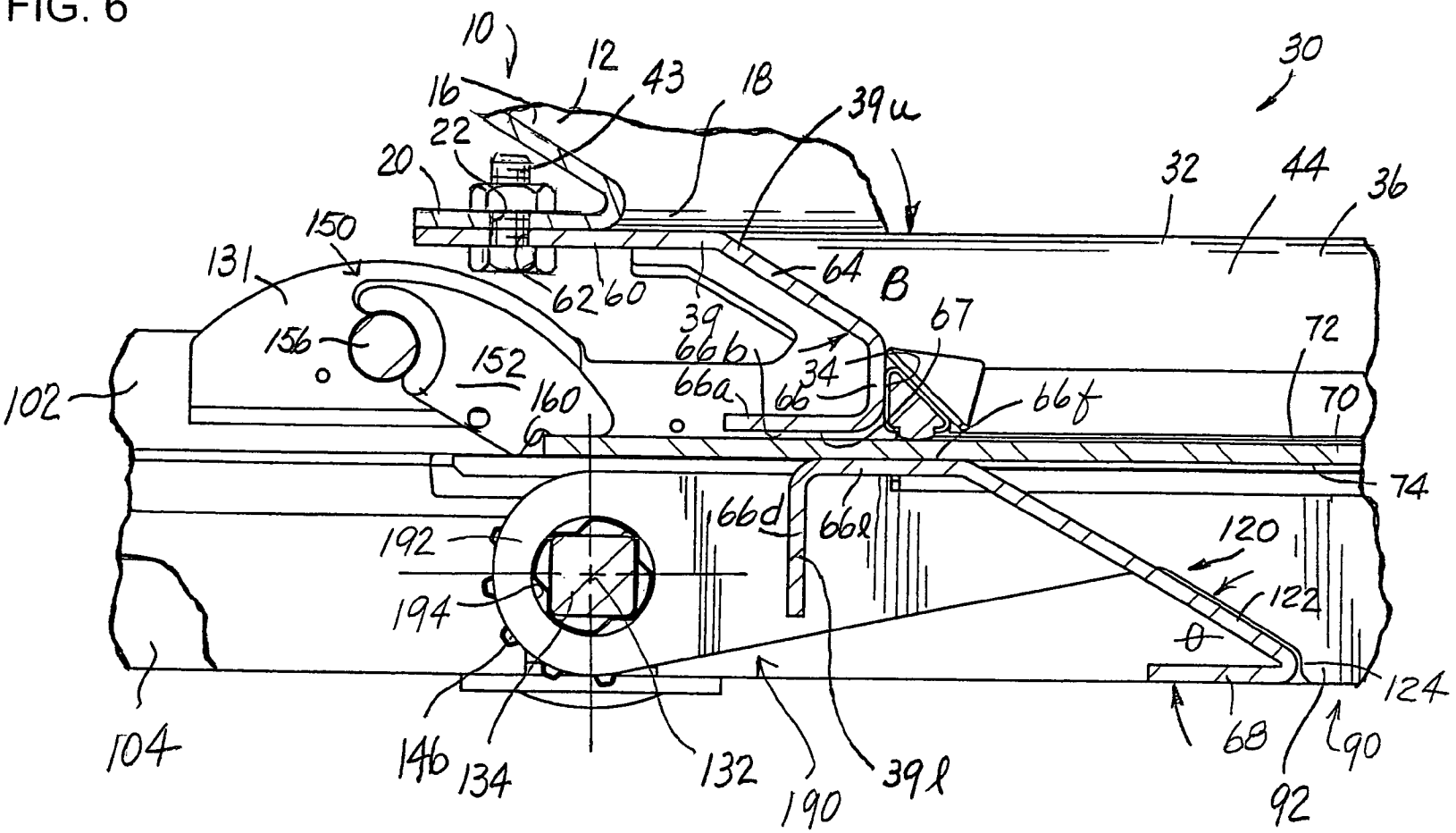
FIG. 6 is a fragmentary enlarged sectional view taken along line 6-6 of FIG. 2.

Turning now to FIG. 6, the end frame member 39 of gate assembly 30 includes an upper portion 39*u* and a lower portion 391 which, in the embodiment illustrated by way of example in FIG. 6, are rigidly fixed between the side frame members 36 and 37 of gate assembly 30 but are preferably separate from each other. As shown in FIG. 6, the upper portion 39*u* of the end frame member 39 includes an outwardly extending, rigid and generally planar mounting flange 60 arranged above an upper surface 72 of the gate 70 and defining a series of side-by-side openings or holes 62 to allow a shank portion of a threaded fastener 43 to extend therethrough whereby facilitating securement of gate assembly 30 to the conventional mounting flange 20 on the bottom of the railcar hopper 12. Notably, the upper mounting flange 60 of the upper portion 39*u* on end frame member 39 is arranged generally coplanar with the mounting flanges 40 on each side frame member 36, 37 and the mounting flange 50 on end member 38.

As further illustrated in FIG. 6, the upper portion 39*u* of the end frame member 39 further includes a horizontally slanted generally planar wall 64 extending downwardly and away from the respective upper mounting flange 60 and inwardly toward the discharge opening 34 of gate assembly 30. Like the slanted walls on the side frame members 36 and 37 and end frame member 38, the slanted wall 64 of the end frame member 39 contributes to the low profile design of the gate assembly 30.

The horizontally slanted wall 64 on the upper portion 39*u* of end frame member 39 extends inwardly toward the discharge opening 34 at angle β relative to a horizontal plane defined by the upper mounting flange 60 on the end frame member 39. In one form, the slanted wall 64 on the upper portion 39*u* of end frame member 39 extends inwardly toward the discharge opening 34 and at angle of less than 30 degrees relative to a horizontal plane defined by the upper mounting flange 60 on the end frame member 39. Preferably, the slanted wall 64 on the upper portion 39*u* of the end frame member 39 extends inwardly toward the discharge opening 34 at angle ranging between about 26 degrees and about 28 degrees. Suffice it to say, the slanted wall 64 on the upper portion 39*u* of the end frame member 39 extends inwardly toward the discharge opening 34 and at angle β which is generally equal to the angle β defined between the slanted walls 44 and 54 of the side frame members 36, 37 and end frame member 38, respectively, of gate assembly 30.

In the embodiment shown in FIG. 6, the upper portion 39*u* of the end frame member 39 also has a depending wall 66 extending generally perpendicular to the upper flange 60 and rigidly joined toward and to a distal end of the horizontally slanted wall 64. In this embodiment, and as shown in FIG. 6, wall 66 of the upper portion 39*u* of the end frame member 39 depends from where it is joined to the horizontally slanted wall structure 44 above the upper surface 72 of gate 70 and terminates in a generally horizontal wall section 66*a* having a surface 66*b* disposed above an upper surface 72 of gate 70. Preferably, the depending wall 66 on the end frame member 39 is formed integral with the mounting flange 60 and the horizontally slanted wall 64 of upper portion 39*u* of the end member 39.

In the illustrated embodiment, the lower portion 391 of the end wall 39 of gate assembly 30 includes a generally vertical wall 66*d* disposed below the lower surface 74 of gate 70 and fixed between the side frame members 36 and 37. The lower portion 391 of the end wall 39 includes the generally vertical wall 66*d* and a generally horizontal wall 66*e* joined to each other. In the embodiment illustrated by way of example in FIG. 6, the generally vertical wall 66*d* of the lower portion 391 of the end wall 39 and the depending wall 66 on the upper portion 39*u* of the end wall 39 are disposed in generally the same vertical plane relative to each other. In the embodiment illustrated by way of example in FIG. 6, the generally horizontal wall 66*e* of the lower portion 391 of the end wall 39 defines a surface 66*f* spaced from surface 66*a* of the upper portion 39*u* of the end wall 39 and which supports the lower surface 74 of the gate 70. The vertical spacing between surfaces 66*b* and 66*f* defines an opening or slot 67 extending transversely across the width of the end member 39 and through which gate 70 slides as it moves in a single generally horizontal path of travel between closed and open positions.

Also, and to add rigidity and strength thereto, and in the embodiment illustrated in FIG. 6, the lower portion 391 of the end frame member 39 further includes a boot flange 68 disposed toward the lower end thereof. As known, the boot flange 68 on the lower portion 391 of the end wall 39 facilitates an unloading sled (not shown) being abutted against the frame 32 of gate assembly 30 when material is to be discharged from car 10 (FIG. 1). The boot flange 68 on the lower portion 391 of the end frame member 39 is vertically spaced from but extends in the same direction and in generally parallel relation with the mounting flange 60 on the upper portion 39*u* of the end wall 39. Preferably, the generally vertical wall 66*d*, the generally horizontal wall 66*e*, and the boot flange 68 on the lower portion 391 of the end frame member 39 are integrally formed with each other. Moreover, the boot flange 68 on the end frame member 39 is preferably arranged in generally coplanar relation relative to the boot flanges 48 of the side frame members 36, 37 and in generally coplanar relation relative to the boot flange 58 of the end frame member 38 of gate assembly 30. This design yields a gate assembly 30 having a low profile while concurrently providing sufficient space between the boot flanges 48, 58 and 68 of the gate assembly 30 and an uppermost surface on the rails 11 (FIG. 1) so as to allow a conventional portable unloading sled to be positioned in material receiving relation beneath gate assembly 30 for unloading of the car 10 (FIG. 1).

In the embodiment shown by way of example in FIG. 2, the spacing between the those portions of the depending walls 46 on the side frame members 36, 37 and the spacing between the depending walls 56 and 66 on the end frame members 38 and 39, respectively, disposed above the upper surface 72 of the gate 70 provides a first discharge opening 34 for the gate assembly with a cross-sectional area of about 1,100 square inches. More specifically, and in one embodiment, the spacing between those portions of the depending walls 46 of the side frame members 36, 37 disposed above the upper surface 72 of the gate 70 measures approximately 54 inches. Moreover, and in one embodiment, the spacing between those portions of the depending walls 56 and 66 on the end frame members 38 and 39, respectively, disposed above the upper surface 72 of the gate 70 measures approximately 20.37 inches.

As shown in FIGS. 2 and 3, seal structure 80 is preferably carried by the gate assembly frame 32 for inhibiting debris and insect infiltration between the frame 32 and the gate 70. In the illustrated embodiment, seal structure 80 is arranged relative to a periphery of the gate 70 when gate 70 is in the closed position.

Figure 7:
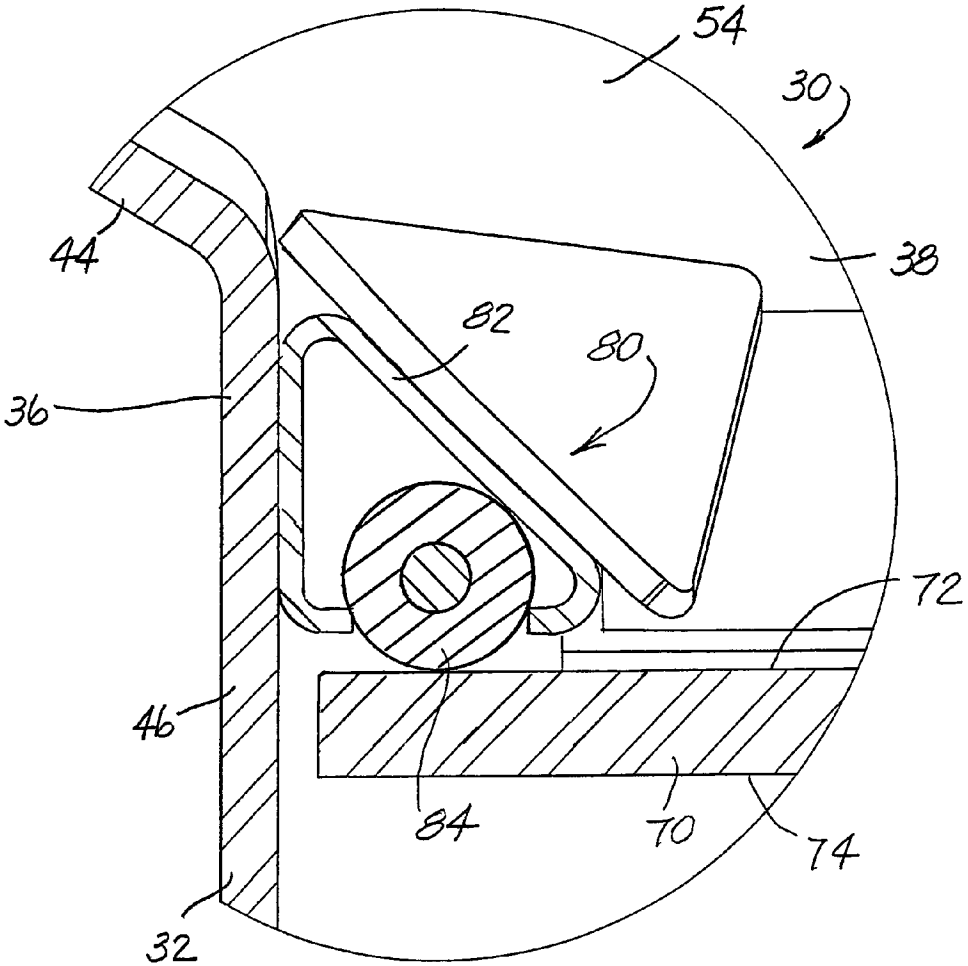
FIG. 7 is an enlarged view of that area encircled in FIG. 4.

In the embodiment illustrated in FIG. 7, seal structure 80 includes a hollow mounting 82 secured to the respective depending walls 46, 56 and 66 of the side frame members 36, 37 and end frame members 38, 39 (with only the side frame member 36 being shown in FIG. 7) of the gate assembly frame 32 above the upper surface 72 of gate 70. The hollow mounting 82 is specifically configured to allow commodity discharged from the hopper 12 of railcar 10 to readily pass thereover. Moreover, structure 80 includes a conventional carpet seal 84, or other suitable seal, accommodated preferably within the mounting 82, and configured to sealingly engage the upper surface 72 of and after gate 70 is moved to a closed position.

In the illustrated embodiment, and to facilitate the discharge of commodity from the car 10 (FIG. 1) and through gate assembly 30, the discharge opening 34 of gate assembly 34 preferably embodies a ledgeless design. That is, and as used herein, the term "ledgeless" refers to a gated discharge opening in which gate 70 is not supported on ledges or runners which extend inwardly of the depending wall structure 46 on the side frame members 36, 37 of gate assembly 30 and beneath the lower surface 74 of gate 70.

Instead, and as shown by way of example in FIGS. 2, 4 and 6, to facilitate the discharge of material through the gate assembly 30, the gate assembly preferably includes structure 90 for supporting the gate 70, in the closed position. As shown in FIG. 2, structure 90 preferably includes a generally centralized support 92 with two additional supports 94 and 96 disposed to opposite sides of the central support 92. Supports 92, 94, and 96 are disposed beneath the closed gate 70, extend generally parallel to the direction of travel of the gate 70 between closed and open positions, and are attached, in laterally spaced relation, to the end frame members 38, 39 of frame 32.

In the illustrated embodiment, a suitable material 98 (FIGS. 4 and 5) is provided between the lower surface 74 of the gate 70 and each support of structure 90 for enhancing sliding movement of the gate 70 from the closed position toward the open position. Preferably, and as shown in FIGS. 4 and 5, an upper surface 99 of each support 90, 92 and 94 (with only support 94 and 92 being shown in FIGS. 4 and 5, respectively) is preferably defined by the material 98 between the lower surface 74 of the gate 70 and each support of structure 90. Preferably, material 98 includes ultra-high molecular weight polyethylene or similar material for reducing the coefficient of friction between the gate 70 and the support structure 90.

Figure 8:
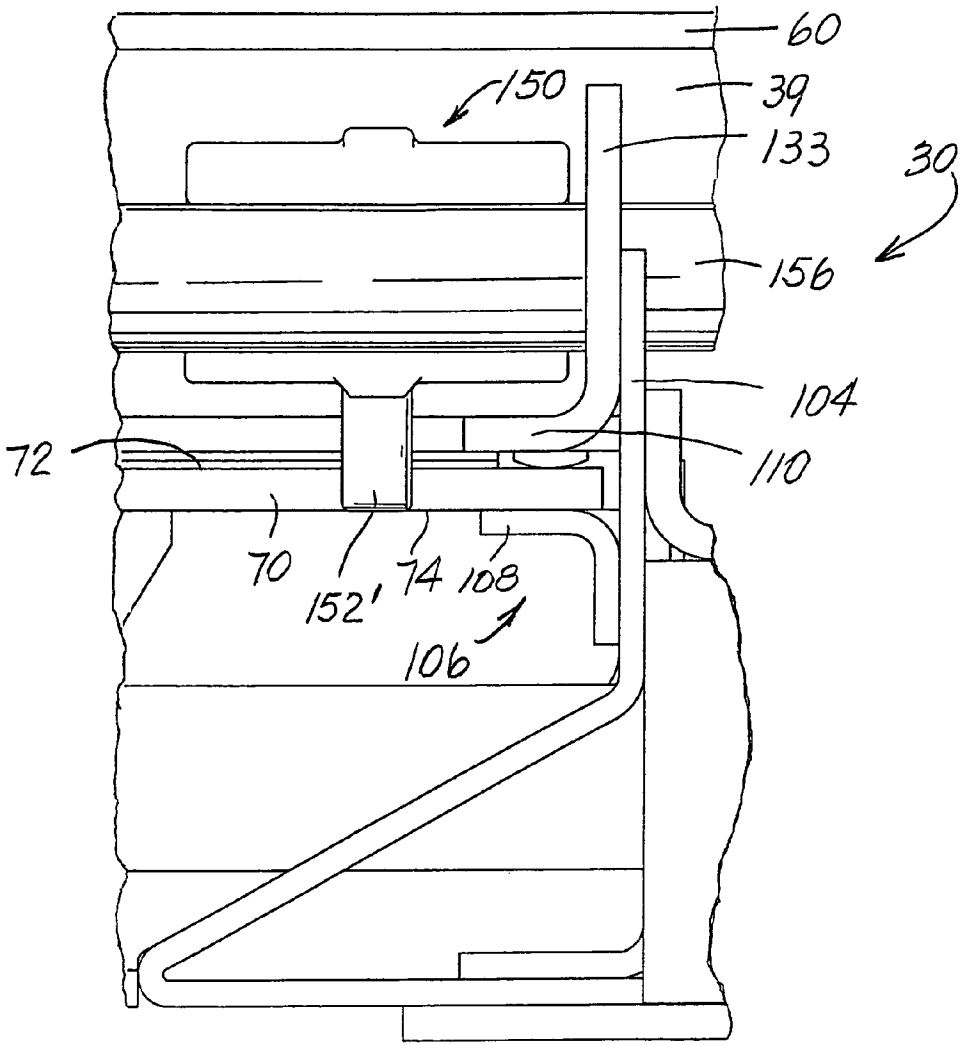
FIG. 8 is fragmentary and enlarged end view of the gate assembly of the present invention disclosure.

As shown in FIG. 2, projecting outwardly from the end frame member 39 and extending in the direction the gate 70 moves toward an open position, the frame 32 further includes generally parallel frame extensions 102 and 104. When viewed from an end of the gate assembly 30, the frame extensions 102 and 104 are minor images of each other. Accordingly, only frame extension 104 will be described in detail. As shown in FIG. 8, each frame extension includes structure 106 projecting away from the discharge opening 34 for supporting the gate 70 when moved to an open position.

As shown by way of example in FIG. 8, structure 106 includes a ledge 108 which is secured beneath the lower surface 74 of gate 70 and projects inwardly toward a center of the gate 70. The ledge 108 extends outwardly from the end frame member 39 and generally parallel to the direction of movement of the gate 70 toward the open position for a distance sufficient to support the opened gate 70. Preferably, and as shown in FIG. 8, structure 106 furthermore includes a hold down bracket 110 which extends generally parallel to and above ledge 108. Bracket 110 is disposed and designed to slidably engage with the upper surface 72 of gate 70, when gate 70 is moved toward the open position, and inhibits gate 70 from inadvertently tipping relative to the gate assembly frame 32.

Figure 6A:
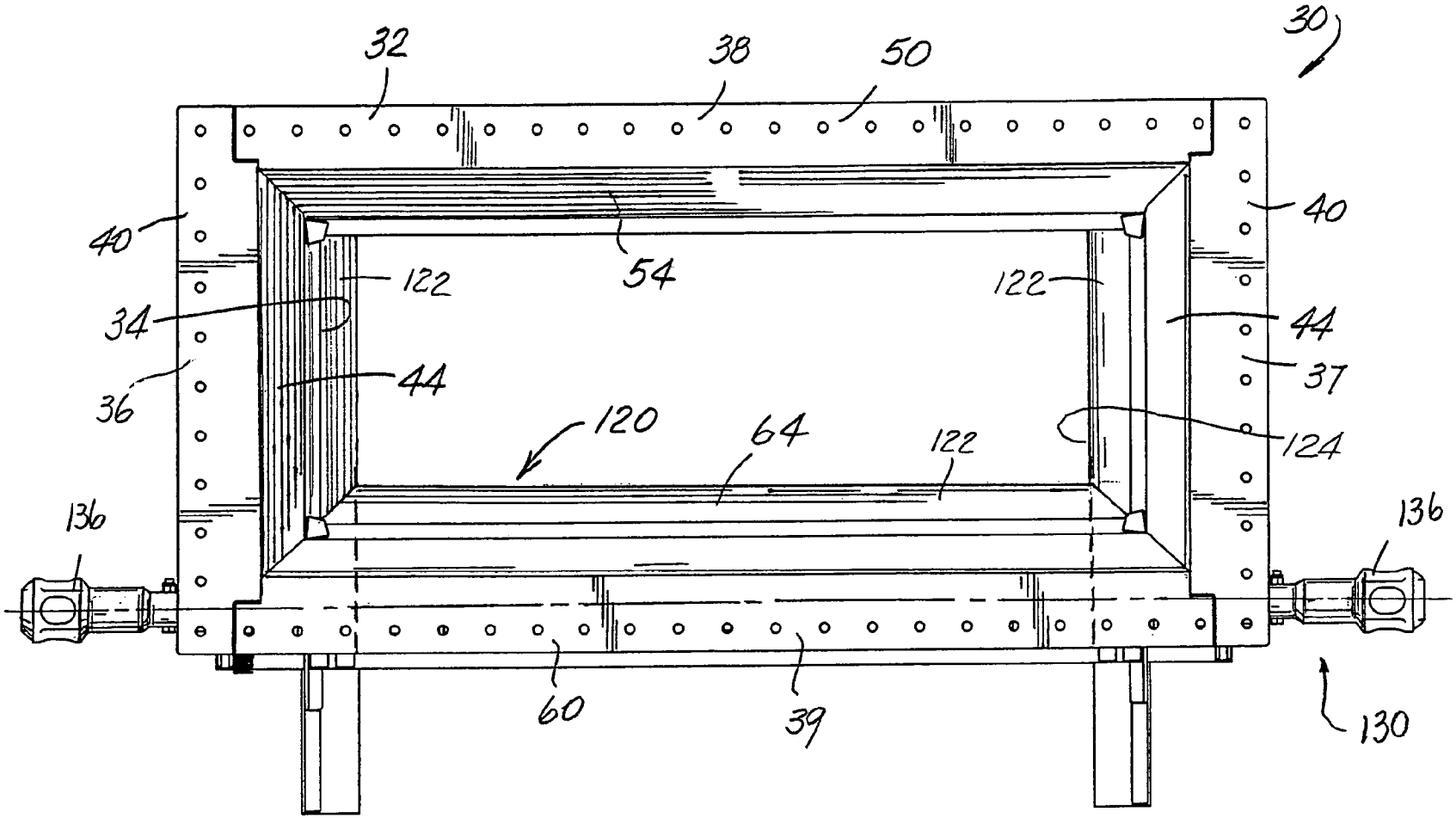
FIG. 6A is a view similar to FIG. 2 but having the gate removed from the frame assembly.

As illustrated by way of example in FIGS. 4, 6 and 6A, gate assembly 30 further includes structure 120 for restricting commodity flowing or passing from the first discharge opening 34 of the gate assembly 30. In the illustrated embodiment, structure 120 is carried by the side frame members 36, 37 and at least one end frame member 39 and is disposed between the lower or boot flanges 48 and 68 of the respective frame members 36, 37 and 39 and the lower surface 74 of the gate 70.

In the embodiment illustrated by way of example in FIGS. 4, 6 and 6A, structure 120 includes a series of horizontally slanted walls or baffles 122. That is, and as illustrated in FIGS. 4 and 6A, both side frame members of the gate assembly 30 carry a horizontally slanted wall or baffle 122 disposed between the lower or boot flange 48 (FIG. 4) of the respective side frame members and the lower surface 74 of the gate 70.

Similarly, and as shown in FIGS. 6 and 6A, the end frame member 39 carries a horizontally slanted wall or baffle 122. As shown in FIG. 6, the slanted wall or baffle 122 on the end frame member 39 of gate assembly 30 is disposed between the lower or boot flange 68 on the lower portion 391 of the end frame member 39 and, in the illustrated embodiment, is connected the generally horizontal wall 66*e* on the lower portion 391 of the end frame member 39 below the lower surface 74 of the gate 70. Preferably, the generally vertical wall 66*d*, the generally horizontal wall 66*e*, the boot flange 68 and the slanted wall 122 on the lower portion 391 of the end frame member 39 are integrally formed with each other.

Preferably, the horizontally slanted walls 122 forming structure 120 are formed integral with the respective side frame members 36, 37 and the lower portion 391 of the end frame member 39 of gate assembly 30. Alternatively, and without departing or detracting from the spirit and scope of this invention disclosure, and with a relatively small design change, the slanting walls 122 forming structure 120 can be designed separately from but attachable to the side frame members 36, 37 and at least the lower portion 391 of the end frame member 39 of gate assembly 30 and disposed between the lower or boot flanges 48 and 68 of the respective frame members 36, 37 and 39 and the lower surface 74 of the gate 70.

In the preferred embodiment shown in FIG. 4, each horizontally slanted wall or baffle 122 on the side frame members of gate assembly frame 32 extends downwardly and away from the depending wall 46 of each side frame member 36, 37 and inwardly of the marginal edge of the discharge opening 34 for the gate assembly 30. The horizontally slanted wall or baffle 122 on each side frame member of gate assembly 30 extends inwardly toward a center of the gate assembly 30 and at angle θ relative to a horizontal plane defined by the lower or boot flange 48 on the respective side frame member of gate assembly 30.

In one form, the horizontally slanted wall or baffle 122 on the side frame members of gate assembly 30 extends inwardly of the marginal edge of the discharge opening and toward a center of gate assembly 30 from a location on the depending wall 46 of each side frame member below the lower surface 74 of gate 70 and at angle of ranging between about 25 degrees and about 45 degrees such that the commodity can gravitationally pass from the gate assembly while minimizing the vertical height of the gate assembly. In a most preferred form, the horizontally slanted wall or baffle 122 on the side frame members of gate assembly 30 extend inwardly of the marginal edge of the discharge opening 34 and toward center of gate assembly 30 from a location on the depending wall 46 of each side frame member below the lower surface 74 of gate 70 and at angle ranging between about 28 degrees and about 30 degrees relative to a horizontal plane defined by the boot flange 48 on each side frame member of gate assembly 30.

Similarly, and as shown in FIG. 6, the horizontally slanted wall or baffle 122 on the lower portion 391 of the end frame member 39 extends inwardly toward a center of the gate assembly 30 and at angle θ relative to a horizontal plane defined by the lower or boot flange 68 on the lower portion 391 of the end frame member 39. In one form, the horizontally slanted wall or baffle 122 on the lower portion 391 of the end frame member 39 extends inwardly toward center of gate assembly 70 from a location on the horizontal wall 66*e* on the lower portion 391 of the end frame member 39 below the lower surface 74 of gate 70 and at angle ranging between about 25 degrees and about 45 degrees relative to a horizontal plane defined by the lower or boot flange 68 on the lower portion 391 of the end frame member 39. In a most preferred form, the horizontally slanted wall 122 on the lower portion 391 of the end frame member 39 extends inwardly toward center of gate assembly 30 from a location on the horizontal wall 66*e* of the lower portion 391 of the end frame member 39 below the lower surface 74 of gate 70 and at angle ranging between about 27 degrees relative to a horizontal plane defined by the lower or boot flange 68 on the lower portion 391 of the end frame member 39.

In effect, the terminal or lowermost edges of the series of horizontally slanted walls or baffles 122 forming structure 120 combine to define a second discharge opening 124 therebetween for the gate assembly 30 which is disposed in material receiving off-set relation beneath the first discharge opening 34 of the gate assembly 30. This second discharge opening 124 defined by the terminal or lowermost edges of the series of horizontally slanted walls 122 forming structure 120 has a cross-sectional area sized between about 25% and about 40% smaller than the cross-sectional area of the first discharge opening 34 of the gate assembly 30 so as to restrict or throttle the flow of commodity from the gate assembly 30. In one form, the second discharge opening 124 defined by the spacing between the terminal or lowermost edges of the series of horizontally slanted walls 122 arranged in operable combination with the side frame members is about 47.13 inches. In one form, the second discharge opening 124 defined by the spacing between the depending wall 56 on the end member 38 (FIG. 5) and the terminal or lowermost edge of the horizontally slanted wall 122 arranged in operable combination with the lower portion 391 of the end frame member 39 is about 14.41 inches. In this form, the second discharge opening 124 of gate assembly 30 is provided with a cross-sectional area of about 680 square inches.

Returning again to FIG. 2, gate assembly 30 further includes a manually actuated operating shaft assembly 130 mounted for rotation about a fixed axis 132 on the frame extensions 102 and 104 of the gate frame 32. The rotationally fixed axis 132 of the operating shaft assembly 130 is disposed in spaced by generally parallel relationship from the end frame member 39 of the gate assembly frame 32. The operating shaft assembly 130 is operably coupled or connected to gate 70 such that rotation of the operating shaft assembly 130 is transmuted to linear movement of the gate 70.

The operating shaft assembly 130 extends transversely across the path of movement of gate 70 and has opposed ends which, after the gate assembly 30 is secured to car 10, are operator accessible from either side of car 10. In the illustrated embodiment, the operating shaft assembly 130 is disposed beneath the predetermined path of movement of the gate 70.

Figure 9:
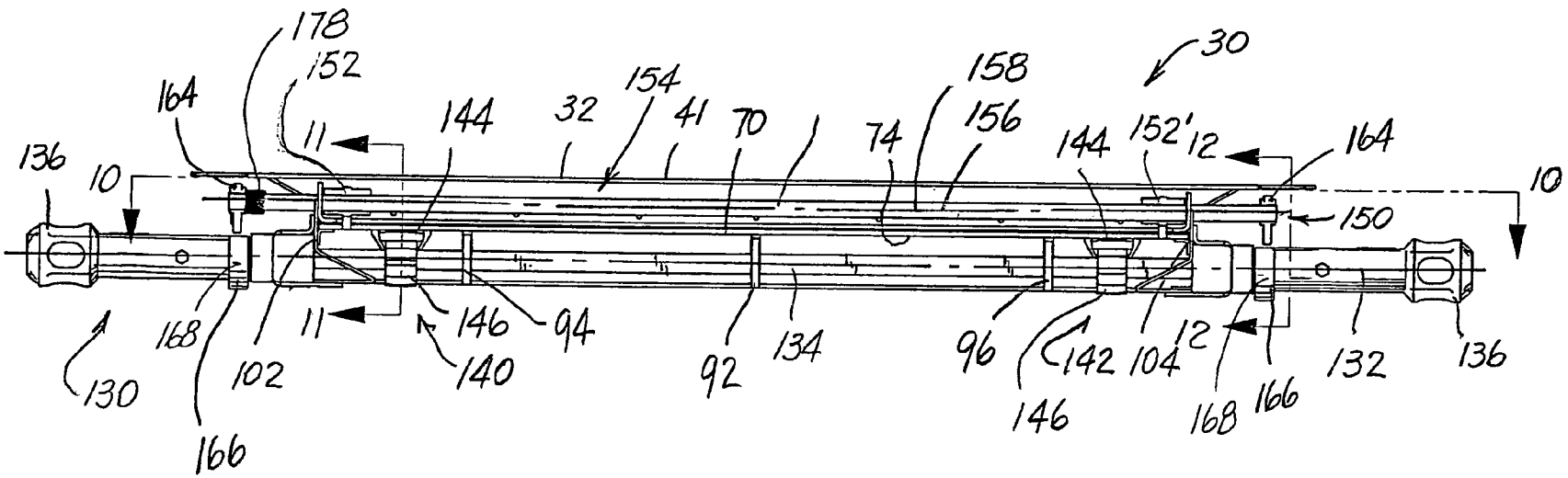
FIG. 9 is an end view of the gate assembly of the present invention disclosure.

As shown in FIG. 9, the operating shaft assembly 130 preferably includes an elongated operating shaft 134 rotatable about axis 132 with operating handles or capstans 136 connected to opposite ends thereof. As is known, the operating handles 136 rotatably mount the operating shaft assembly 130 to the frame extensions 102, 104 of the gate assembly frame 32. In a most preferred form, the capstans or operating handles 136 are releasably secured to the shaft 134.

A drive mechanism 140 operably couples the operating shaft assembly 130 to the gate 70. In the illustrated embodiment, drive mechanism 130 includes a rack and pinion assembly 142. Preferably, assembly 142 includes a pair of laterally spaced racks 144 fixed to the lower surface 74 of gate 70. A pair of pinions 146 are slidably received about shaft 134 and are arranged in meshing engagement with the racks 144. Thus, the racks 144 are simultaneously moved in timed relation relative to each other by the pinions 146. The racks 144 preferably embody a design similar to that illustrated in U.S. Design Pat. No. 427,741 assigned to Miner Enterprises, Inc.; the full disclosure of which is incorporated herein by reference.

Movement of the gate 70 from a closed position toward an open position along its fixed path of movement is influenced by a lock assembly 150. The purpose of the lock assembly 150 is to releasably hold gate 70 against movement toward an open position until the lock assembly 150 is purposefully released by the operator. With the present invention disclosure, and in compliance with AAR Standards, lock assembly 150 is preferably configured such that it is initially released in response to operation of the operating shaft assembly 130 automatically followed by movement of the gate 70 toward an open position. That is, unlatching of the lock assembly 150 and opening of the gate 70 are preferably affected in sequential order relative to each other and in response to rotation of the operating shaft assembly 130.

Figure 10:
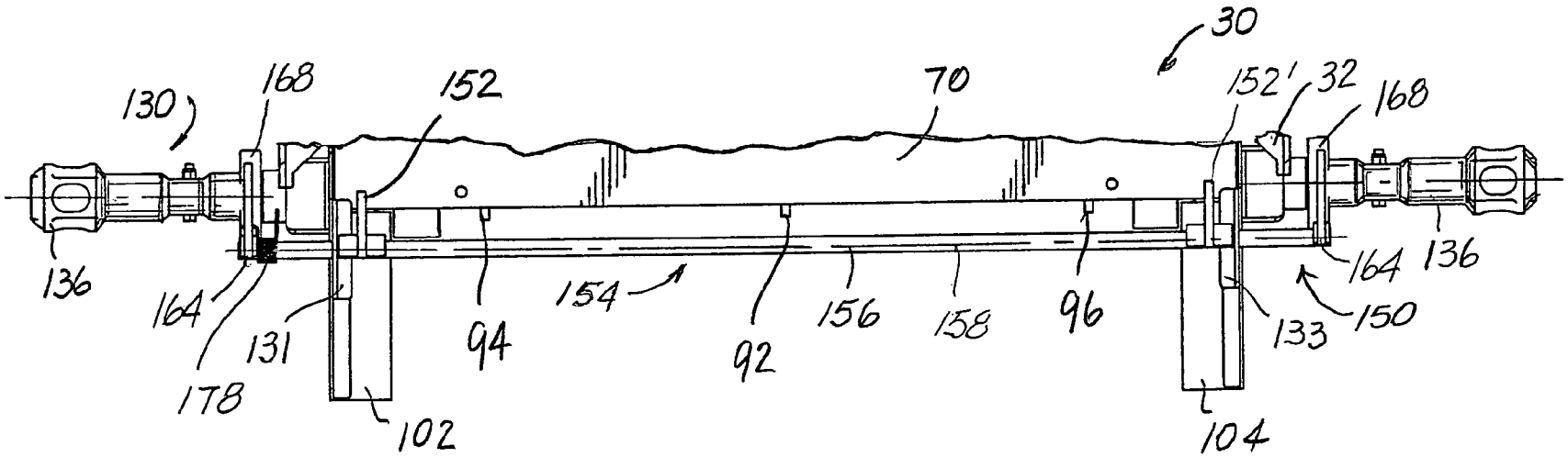
FIG. 10 a sectional view taken along line 10-10 of FIG. 9.
Figure 11:
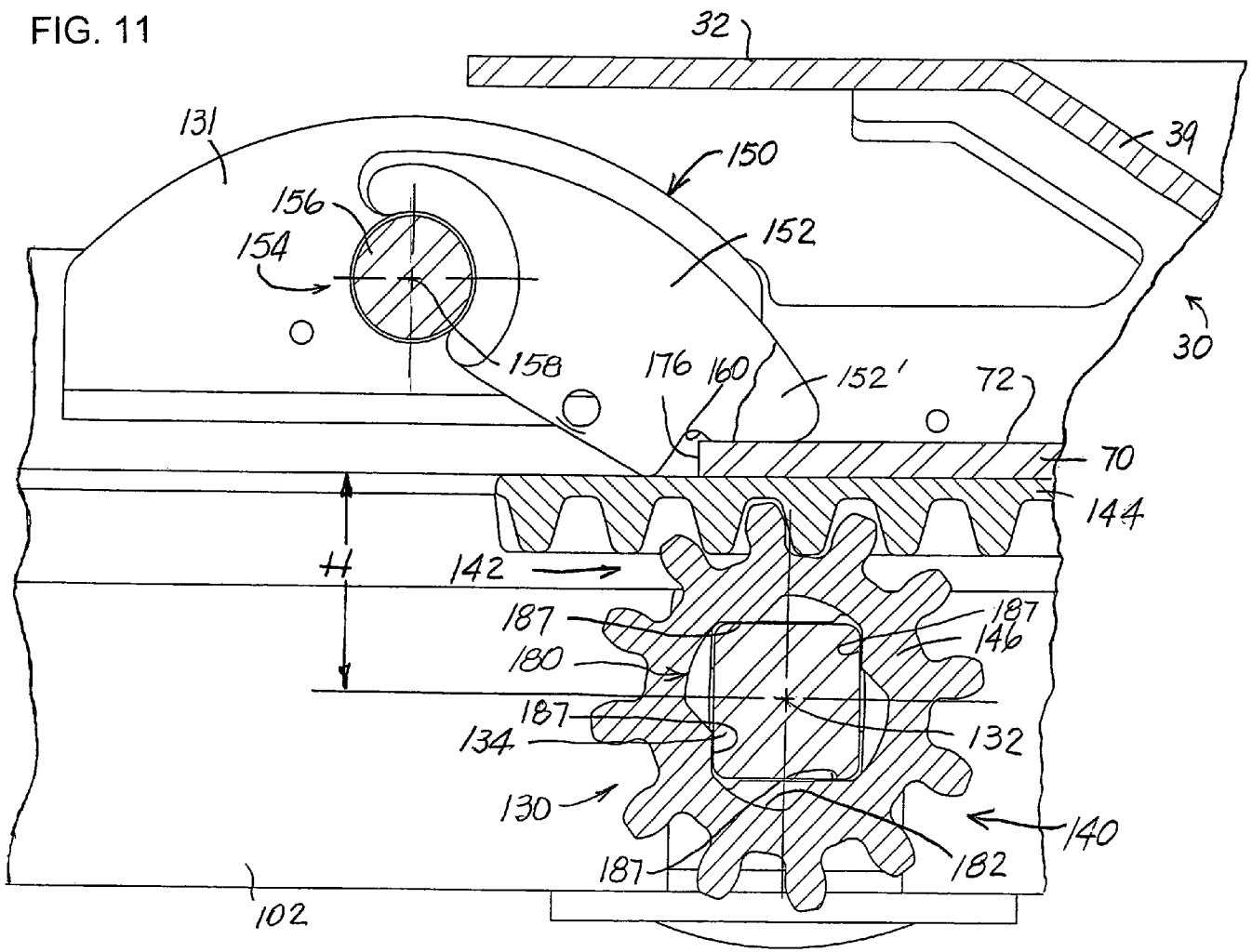
FIG. 11 is an enlarged sectional view taken along line 11-11 of FIG. 9.

In one form, lock assembly 150 is preferably designed as a subassembly and can be fabricated independent of the frame 32 and subsequently added thereto. As shown in FIGS. 10 and 11, lock assembly 150 includes a stop 152 mounted for movement between a first position, wherein stop 152 is disposed in the path of movement of the gate 70 to inhibit inadvertent movement of the gate 70 from the closed position toward the open position, and a second position, wherein stop 152 is removed from the path of movement of the gate 70. Lock assembly 150 further includes a mechanical system 154 for moving the stop 152 between the first and second positions in timed sequential movement relative to movement of the gate 70 toward the open position.

In the embodiment illustrated by way of example in FIG. 10, the mechanical system 154 includes a rockshaft 156 with the stop 152 secured for movement therewith. As shown in FIG. 11, after lock assembly 150 is secured to frame 32, shaft 156 is preferably arranged above the upper surface 72 of the gate 70 and generally parallel thereto. Shaft 156 is mounted for oscillatory movement about a fixed axis 158 extending generally parallel to axis 132 about which shaft assembly 130 turns. In one form, a pair of laterally spaced brackets 131 and 133, secured to and extending upwardly from the frame extensions 102 and 104, respectively, mount the rockshaft 156 to the gate assembly frame 32. Preferably, when subassembly 150 is secured to the gate assembly frame 32, the rockshaft 156 thereof is disposed above and downstream of a rearmost edge 76 of the gate 70 (FIG. 11), when the gate 70 is in the closed position to promote visualization of the lock assembly 150 relative to gate 70. Moreover, the rockshaft 156 is spaced above and lengthwise from the shaft assembly 130.

Preferably, and as shown in FIG. 11, stop 152 depends angularly downward from the rockshaft 156 and a free end of the stop 152 extends toward and into positive engagement with the gate 70. Preferably, the free end of stop 152 is configured with a notch or recess 160 for engaging the edge 76 of the gate 60 while limiting angular movement of the stop 122 therepast. Preferably, the operative distance separating the notch 160 from the axis 158 of the rockshaft 156 is greater than the distance separating the axis 158 of the rockshaft 156 from the upper side or surface 72 of gate 70. Accordingly, when the stop 152 engages the gate 70, a wedging action is preferably created or established. In a preferred form, the rockshaft 156 is inhibited against axial shifting movements along axis 158 by any suitable means.

Preferably, and as illustrated in FIG. 10, lock assembly 150 further includes a second stop 152' arranged in laterally spaced relation from stop 152. Stop 152' is substantially similar to the stop 152 and, thus, no further detailed description need be provided for stop 152'.

Figure 12:
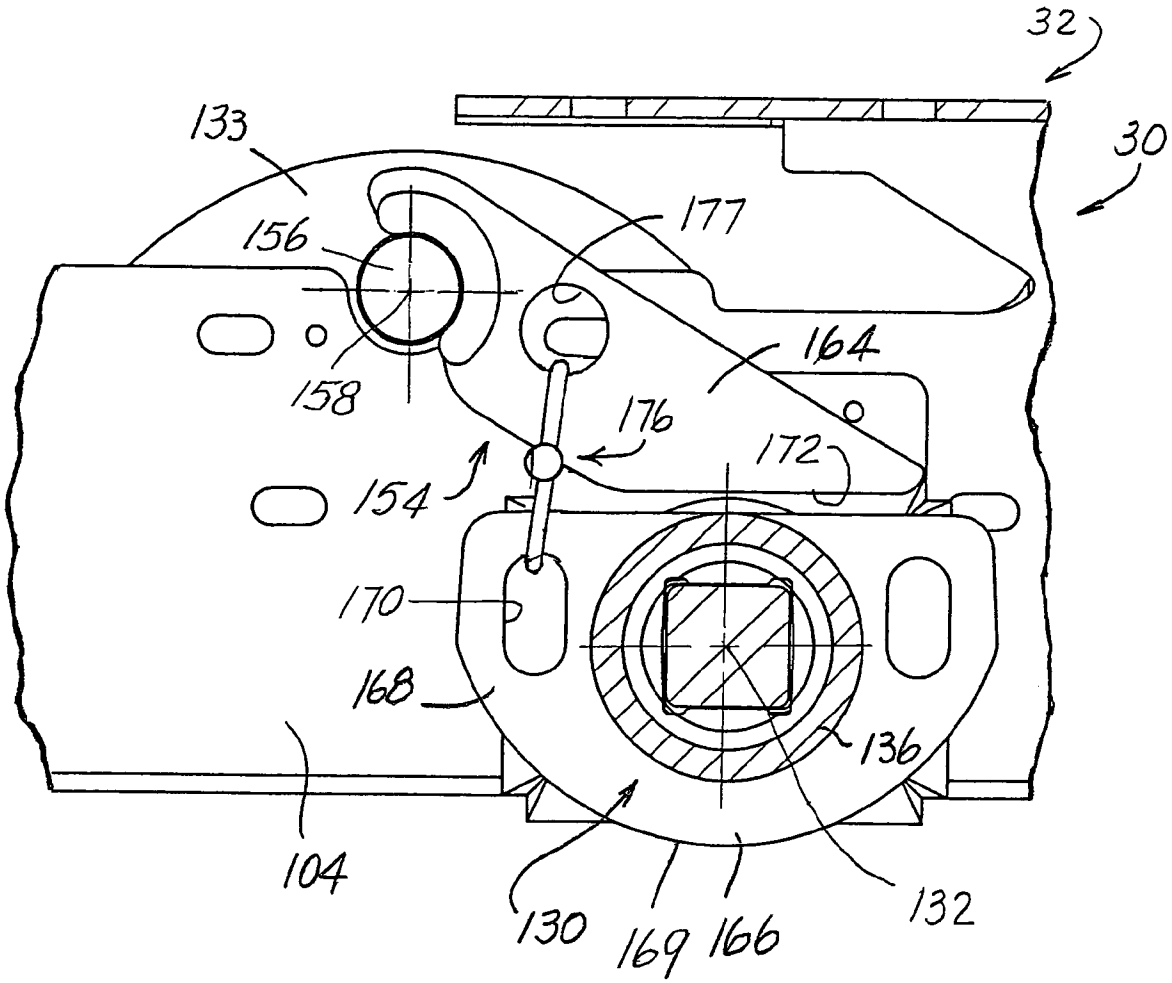
FIG. 12 is an enlarged sectional view taken along line 12-12 of FIG. 9.

As shown in FIG. 12, the mechanical system 154 for operating the lock assembly 150 (FIG. 11) in timed sequence with movement of the gate 70 (FIG. 11) further includes at least one cam follower 164 secured to and radially extending from rockshaft 156. The free end of the follower 164 is adapted to cooperate with cam structure 166 on shaft assembly 130 whereby the stop 152 of the lock assembly 150 (FIG. 11) will be positively displaced relative to the path of movement of the gate 70 upon rotation of the shaft assembly 130.

In the embodiment shown by way of example in FIG. 12, the cam structure 166 for displacing the stop 152 (FIG. 11) includes an actuating member or cam 168 provided to the side of the gate assembly frame 32 on at least one of the operating handles or capstans 136 of the operating shaft assembly 130. Such design increases the potential throw or movement of the lock assembly 150 (FIG. 11) while allowing the cam follower 164 of the mechanical system 154 to be advantageously disposed adjacent to the gate assembly frame 32. In the embodiment shown in FIG. 9, another cam follower and associated cam structure is provided at the other end of the mechanical system 154 and operating shaft assembly 130.

Since the cam structure at each end of the operating shaft assembly 130 is substantially identical, only one actuating member or cam 168 will be described in detail. As shown in FIG. 12, each cam 168 is preferably formed as an integral part of the handle 136 on shaft assembly 130 and includes a peripheral surface 169. Notably, at least a portion of each cam 168 is larger in diameter and extends radially outward from that portion of the operating handle 136 preferably joined thereto. For purposes to be described below, each actuating member or cam 168 defines a throughbore or slot 170, having a closed margin, arranged in radially spaced relation relative to the rotational axis 132 of the operating shaft assembly 130.

Along its underside, the cam follower 164 includes a cam engaging surface 172 specifically configured to inhibit the follower 164 from binding against the peripheral surface 169 of the cam 168. Moreover, each cam follower 164 is preferably configured to promote arrangement of a tamper seal 176 (FIG. 12) in only one position of the lock assembly 150. In the embodiment shown in FIG. 12, the cam follower 164 defines an opening or hole 177 having a closed margin. In one form, the tamper seal 176 comprises a ribbon-like member adapted to be passed through the throughbore or slot 170 in the cam 166 and the opening or hole 177 in the cam follower 164, with opposite ends of the seal 176 being joined to each other to provide a visual indication of railcar tampering.

Besides being gravitationally urged into engagement with the gate 70, in a preferred embodiment, stop 152 is urged into positive engagement with the gate 70 so as to inhibit inadvertent release of the lock assembly 150 as the railcar travels between locations. Returning to FIGS. 9 and 10, shaft 156 of the mechanical system 154 is resiliently biased by a suitable torsion spring 178 operably engagable between the gate assembly frame 32 and the adjacent cam follower 164 to resiliently urge stop 152 toward its first position, thus, preventing stop 152 from inadvertent disengagement from gate 70. The preferred spring arrangement 178 furthermore allows the follower 164 to advantageously remain in operative engagement with the periphery of the cam structure 166 during turning rotational movements of the operating shaft assembly 130.

Preferably, a lost motion mechanism 180 is operably disposed between the operating shaft assembly 130 and the mechanical system 154 for operating the lock assembly 150 so as to effect sequential movement of the lock assembly stop 150 and the gate 70 in predetermined relation relative to each other. The purpose of the lost motion mechanism 180 is to permit the operating shaft assembly 130 to rotate about an angle of free rotation without corresponding movement of the gate 70. As used herein, the term "free rotation" refers to that rotation of the operating shaft assembly 130 suitable to unlatch the lock assembly 150 from the gate 70 prior to effecting displacement of the gate 70 toward an open position.

The lost motion mechanism 180 can take different designs without detracting or departing from the spirit and scope of this invention disclosure. In the embodiment illustrated by way of example in FIGS. 11 and 13, shaft 134 of the operating shaft assembly 130 has a generally square cross-sectional configuration. Moreover, in the embodiment shown, the pinions 146 of drive mechanism 140 (FIGS. 9 and 11) each define a slip socket or slotted configuration 182 specifically related to the cross-sectional configuration of and through which the shaft 134 of shaft assembly 130 endwise passes. The slip socket configuration 182 in each pinion 146 has a duodecimal surface configuration preferably centered about the fixed axis 132 of operating shaft assembly 130 and defines a rotary path for the operating shaft relative to each pinion 146 of drive mechanism. Without incurring serious redesign, an alternative version of the lost motion mechanism 180 can be incorporated into the operating handles or capstans 136 of the operating shaft assembly 130.

Figure 13:
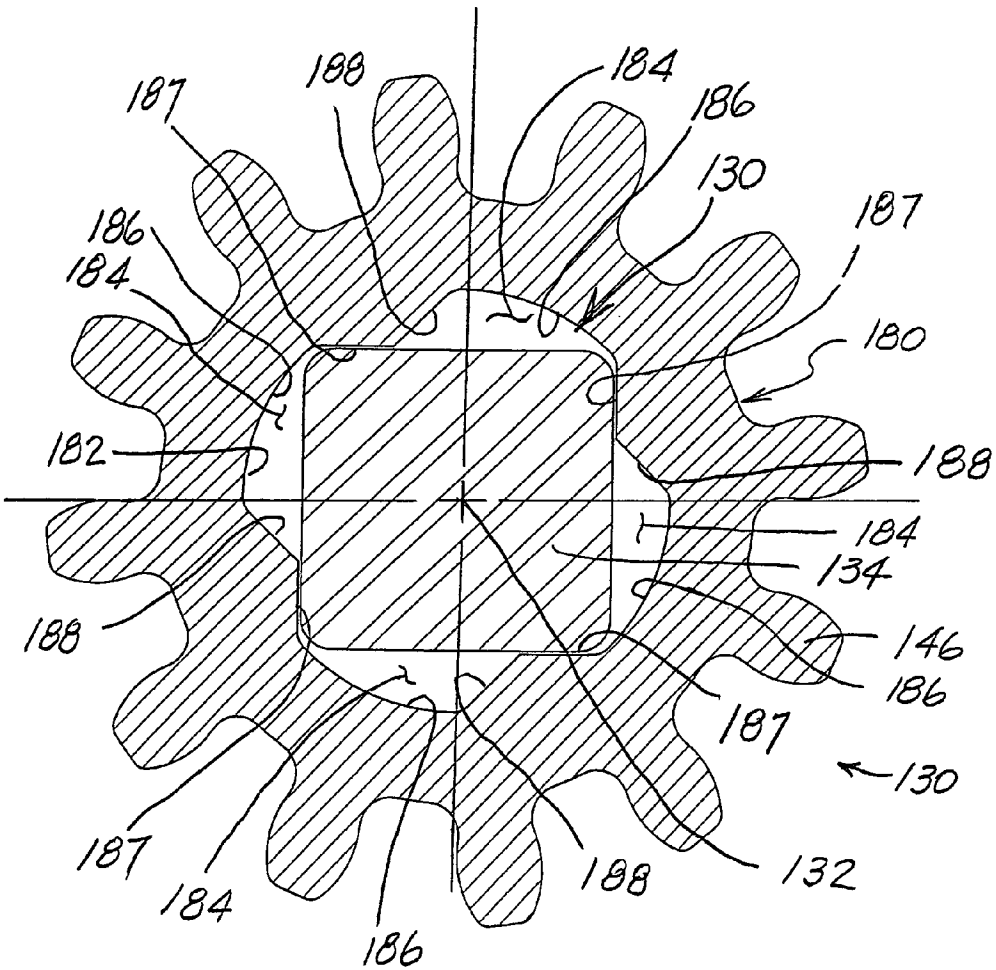
FIG. 13 is an enlarged elevational view of a pinion forming part of a drive mechanism for moving the gate between closed and open positions.

Turning to FIG. 13, because shaft 134 has a square cross-sectional configuration, the slotted configuration in each pinion 146 includes four equally spaced recesses 184 joined to each other and equally disposed about axis 132 of operating shaft assembly 130. As shown in FIG. 13, each recess 184 includes first, second, and third walls or surfaces 186, 187 and 188, respectively. Each wall or surface defined by the recess 184 defines the limit of rotation of shaft 134. The wall or surface 186 of each recess 184 in the slip socket 182 of pinions 146 has a curvilinear configuration and a radius equal to one-half the distance between diametrically opposed corners on shaft 134. The angular offset between the walls or surfaces 187 and 188 of each recess 184 in the slip socket 182 defined by pinions 146 limits the free rotational movement of the operating shaft assembly 130 about axis 132. As will be appreciated, if the cross-sectional configuration of shaft 134 were other than square, the configuration of the slip socket 182 defined by the pinions 146 may likewise be altered to accommodate a predetermined angle of free rotation of the operating shaft assembly 130.

As will be appreciated, timed unlatching or removal of the lock assembly stop 152 from the path of movement of the gate 70 is critical to proper performance of gate assembly 30. Of course, and since the AAR Standards require unlatching of the gate 70 to relate to operation shaft assembly 130, inadvertent skipping movements of the pinions 146 relative to the racks 144 will destroy such timed relationship. It is not unusual, however, for the pinions 146 to skip relative to the racks 144, thus, hindering timing of operation between the gate 70 and lock mechanism 150 when a high level of torque is inputted to the shaft assembly 130. Such high levels of torque typically result during the initial openings stages for gate 70. Such high levels of torque tend to cause the shaft 134 of assembly 130 to deflect relative to its rotational axis 132 thereby resulting in displacement of the pinions 146 relative to the racks 144, thus, destroying timed movement of the gate 70 with operation of the operating shaft assembly 130.

In the embodiment illustrated in FIG. 11, the dimension H between the bottom or lower surface 74 of the gate 70 and the rotational axis 132 of the operating shaft assembly 130 is critical to the overall functionality of the gate assembly 30 because the racks 144 of the drive mechanism 140 are mounted to the lower surface 74 of the gate 70 and because the drive pinions 146 are mounted to the operating shaft 130. If the drive pinions 146 are too close to the racks 144 as a result of displacement of the operating shaft 134 relative to axis 132, drive mechanism 140 will tend to bind. If the drive pinions 146 move too far away from the racks 144 as a result of displacement of the operating shaft 134 relative to axis 132, there is an opportunity for the teeth on the pinions 146 to slip relative to the teeth on the racks 144 whereby causing the drive mechanism 140 to "skip." When "skipping" occurs, the operating shaft 134 can rotate without corresponding linear displacement of the gate 70. As a result, adverse timing of the lock assembly 150 can occur.

Figure 14:
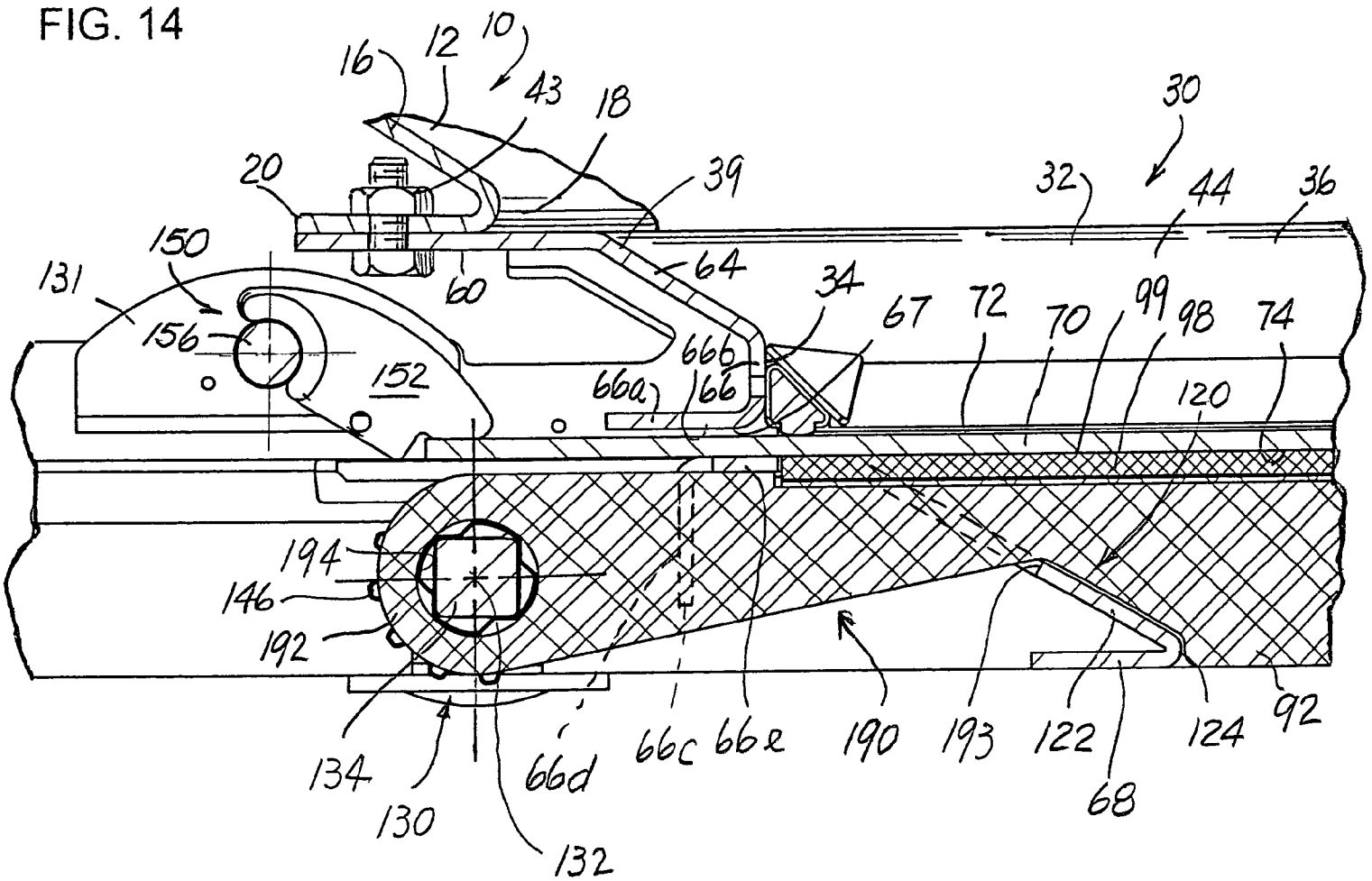
FIG. 14 is an enlarged fragmentary side sectional view taken along line 14-14 of FIG. 2.

Turning to FIG. 14, the vertical location of the lower surface 74 of gate 70 is determined by the location of the upper surface 99 of the supports 92, 94 and 96. In order to maintain the dimension H (FIG. 6) at the correct measurement relative to the rotational axis 132 of operating shaft 134 whereby insuring proper operation of drive mechanism 140, structure 190 is preferably provided in operable combination with the gate assembly frame 32 for guiding and supporting the operating shaft 134 of assembly 130. In the form shown in FIG. 14, structure 190 uniquely includes a longitudinal extension 192 of the supports 92, 94 and 96 (with only the longitudinal extension of support 92 being shown) from beneath the discharge opening 34 and beyond the lower portion 391 of the end frame member 39 of the gate assembly frame 32. That is, the extension 192 is preferably formed as an integral part of each support 92, 94 and 96. As shown in FIG. 14, the lower portion 391 of the end frame member 39 of gate assembly frame 32 defines a notch or recess 193 through which the longitudinal extension 192 of each gate support 92, 94 and 96 (FIGS. 2 and 3) extends. To add strength and rigidity to the gate assembly frame 32, a suitable weldment (not shown) secures and fixes the extension 192 and respective gate support 92, 94 and 96 to that area of the lower portion 391 of the end frame member 39 through which the respective gate support longitudinally extends.

As shown in FIGS. 6 and 14, each extension 192 is structured to guide and support the operating shaft 134 of assembly 130. In one form the structure used to guide and support shaft 134 of assembly 130 includes a closed marginal opening 194 defined by each extension 192 and arranged in surrounding relation relative to shaft 134 of assembly 130. The bore or opening 194 is located relative to axis 132 and sized relative to the cross-section of the shaft 134 of assembly 130. As such, the closed margin defined by each bore 194 ensures true or axial rotation of the shaft 134 relative to axis 132 while restricting deflection of shaft 134 relative to axis 132. Alternatively, and without detracting or departing from the spirit and scope of this aspect of the invention disclosure, the structure used to guide and support shaft 134 of assembly 130 can include a bushing or bearing carried toward the end of each extension 192 and arranged in surrounding relation relative to shaft 134 of assembly 130.

By manufacturing or forming the extension 192 as an integral part of each support 92, 94 and 96 for the gate 70, any tolerance variation between the support surface 99 for the gate 70 and the structure for supporting and guiding the shaft 134 of assembly 130 is minimized since both features involve the same part or component of the gate assembly. As will be appreciated, limiting deflection of the shaft 134 relative to axis 132 facilitates maintaining dimension H generally constant and thereby maintaining the pinions 146 mounted on and along shaft 134 in proper intermeshing and operable engagement with the racks 144 on gate 70 regardless of the torque level inputted to operating shaft assembly 130 whereby guarding against "binding" and "skipping" of the drive mechanism 140. Moreover, forming structure 190 as a simple extension of the supports 92, 94 and 96, significantly simplifies fabrication of the gate frame 32. Additional strength is also added to the gate frame assembly 32 by having the extensions 192 formed as an integral part of the supports 92, 94 and 96.

Operation of the gate 70 and lock assembly 150 is such that when gate 70 is in a closed position, each stop 152, 152' of lock assembly 150 (FIG. 11) is in positive engagement with gate 70 and shaft 134 of the operating shaft assembly 130 is disposed relative to the slip pinions 146 substantially as shown in FIG. 11. Gate 70 is locked in its closed position at this time. With the gate 70 closed, as shown in FIG. 11, the outer surface of shaft 134 extends generally parallel to and likely engages the walls or surfaces 187 of each slip socket or recess 184 of each slip pinion 146.

As discussed above, in the closed position, gate 70 is supported within the discharge opening 34 by the support structure 90 (FIGS. 2 and 5) extending across the discharge opening 34 beneath the gate 70. The seal structure 80 surrounds the periphery of the gate 70 to inhibit contaminants, moisture, and insect infiltration from passing between the gate assembly 32 and the door or gate 70.

Supports 96 and 98 are preferably disposed adjacent the side frame members 36, 37 of gate assembly frame 32 in a manner maximizing the effectiveness of the seal structure 80 about the peripheral edge of the gate 70 and, thus, reducing leakage of commodity therepast. The preferred arrangement of the supports 96 and 98 adjacent to the side frame members 36, 37 on the gate assembly frame 32 furthermore maximizes the clearance for and reduces obstructions to commodity passing from hopper 12 (FIG. 1). As will be appreciated, providing a UHMW-type material 98 between the support structure 90 and the underside 72 of the gate 70 furthermore reduces the coefficient of friction therebetween whereby lessening the torque requirements required to be inputted to assembly 130 to move gate 70 toward the open position.

When gate 70 is to be opened, a suitable tool or powered driver (not shown) operably engages with and is operated to turn or rotate the operating shaft assembly 130 in the appropriate direction. In the embodiment illustrated in FIGS. 15 and 16, shaft assembly 130 is turned in a counterclockwise direction to open the gate 70. As will be appreciated, rotation of shaft assembly 130 causes rotation of shaft 134 along with the operating handles or capstans 136 interconnected by shaft 134. As shown, turning shaft assembly 130 likewise causes rotation of the cam structure 166 while also resulting in breakage of the tamper seal 176 (FIG. 12).

During initial rotation of shaft assembly 130, the cam structure 166 actuates the mechanical system 154 of lock assembly 150. That is, initial rotational movement of the shaft assembly 130 forcibly and positively displaces the cam follower 164 against the action of spring 178 (FIGS. 9 and 10) resulting in counterclockwise rotation of the rockshaft 156 as shown in FIG. 15. As shown in FIG. 16, counterclockwise rotation of the rockshaft 156 effects displacement and removal of the stops 152, 152' from the predetermined path of travel of gate 70.

As shown in FIG. 16, during initial rotational movement of the operating shaft assembly 130 in a direction to move the gate 70 toward an open position, shaft 134 traverses the radial space between surfaces 187 and 188 in the slotted recesses 184 of each slip pinion 146 and no linear movement is imparted to the gate or door 70. That is, during initial rotational movement of the operating shaft assembly 130 in a direction to move the gate 70 toward an open position, the operating shaft assembly 130 turns through a range of free angular movement ranging between about 35° to about 55° without any corresponding linear movement of the gate 70 toward an open position. In a most preferred form, the shaft assembly 130 turns through a range of free angular movement of about 45°. It is through this range of free angular movement of the operating shaft assembly 130, wherein there is no displacement of gate 70 toward the open position, that the mechanical system 154 unlatches/unlocks the lock assembly 150 from operable engagement with gate 70.

At the limit of free rotational movement of operating shaft assembly 130, shaft 134 is disposed as shown in FIG. 16 within the slip socket 182 of each pinion 146 of assembly 142. In such position, the outer surfaces on shaft 134 extend generally parallel with and likely engage the third wall or surface 188 of each slip socket 182 of each pinion 146 of assembly 142.

Figure 17:
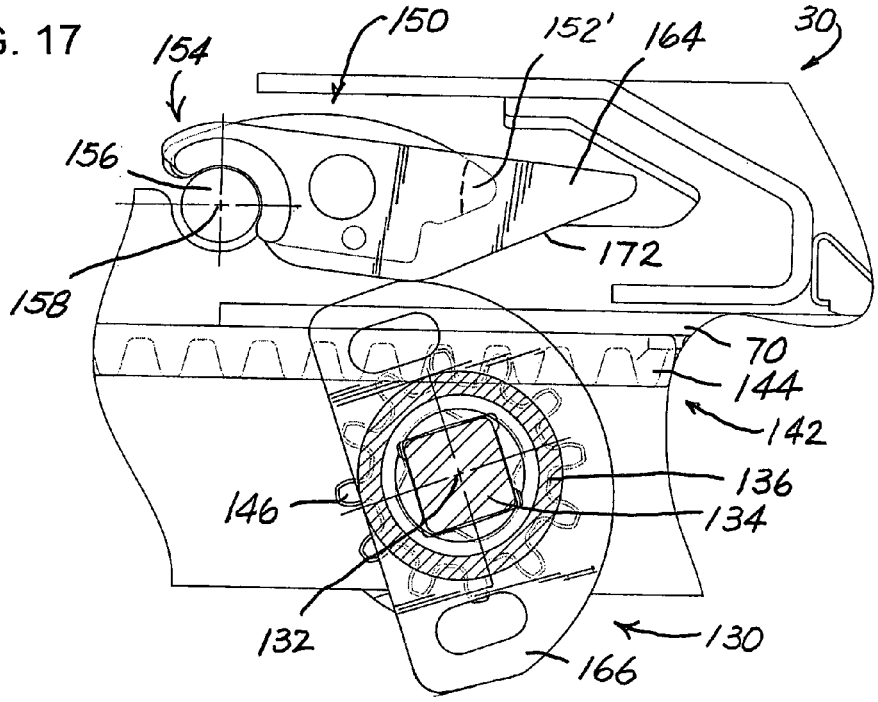
FIG. 17 is a fragmentary sectional side view similar to FIG. 15 but showing further rotation of the operating shaft assembly to move the gate toward the open position.
Figure 18:
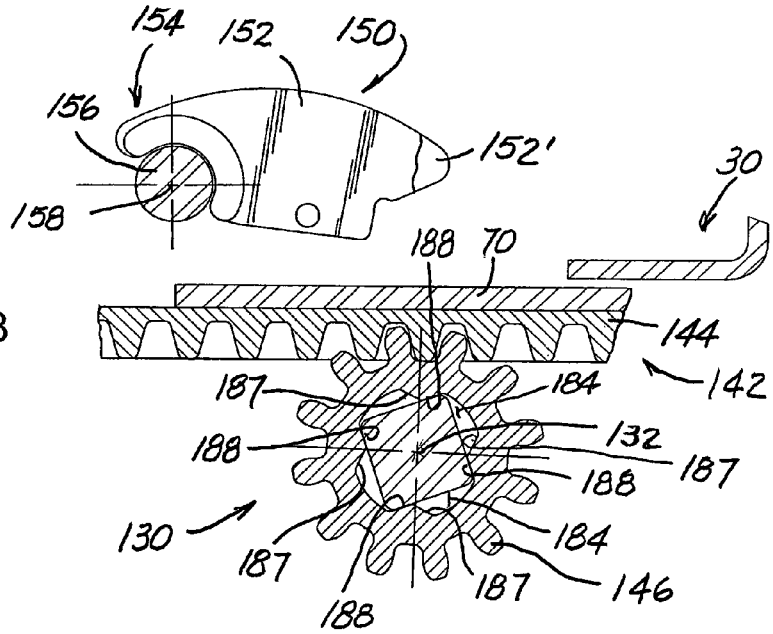
FIG. 18 is a fragmentary sectional side view showing the relationship of various component parts of the present invention when the operating shaft assembly is rotated to the position shown in FIG. 17.

As shown in FIG. 17, continued rotation of operating shaft assembly 130 in a direction to move the gate 70 toward the open position causes the cam structure 166 to further displace or move the stops 152, 152' against the action of spring 178 (FIGS. 9 and 10) while concomitantly resulting in rotation of the pinions 146 and linear displacement of the gate 70 toward an open position. That is, once the lost motion mechanism 180, provided by the shaft 134 traversing the distance separating radial surfaces 187 and 188 (FIG. 16) of the slip pinions 146 collapses, the pinions 146 are thereafter operably coupled to the shaft 134 resulting in linear displacement of the gate 70 toward the open position. After the lock assembly 150 is unlatched or released from the operable engagement with gate 70, the cam structure 166 (FIGS. 17 and 18) is configured such that the stops 152, 152' are positioned and maintained out of engagement with the gate 70 until gate 70 is returned to the closed position.

With gate 70 now moved to an open position, commodity within the hopper 12 (FIG. 1) can be discharged therefrom. With the present invention disclosure, and, more particularly, sizing the second discharge opening 124 of the gate assembly 30 between about 25% to about 45% smaller than the discharge opening 34, the flow of commodity from the discharge gate assembly 30 is restricted or throttled while maintaining a standard size opening 22 on each chute 16 of the hopper car 10 (FIG. 1). Moreover, the ability to maintain a standard size opening 22 on each chute 16 of the hopper car 10 (FIG. 1)

reduces the likelihood of the commodity spilling or otherwise being lost during the commodity unloading process.

Moreover, designing the gate assembly 30 with a low profile of less than 7.5 inches yields several distinct advantages. First, the size and capacity of the hopper 12 on car 10 (FIG. 1) can be increased whereby promoting economic transportation of various commodities within hopper 12. Second, the low profile of the gate assembly 30 enhances movement of the car over track irregularities, and curved rails and well as switches and other rail encumbrances wherein the height of the rails 11 (FIG. 1) can vary. Furthermore, the low profile design of the gate assembly 30 allows a conventional unloading sled system to fit between the uppermost portions of the rails 11 (FIG. 1) and the boot flanges 48, 58 and 68 of the gate assembly 30 to effect unloading of the car 10 at almost any location where the railcar can be safely parked and accessed.

After the commodity is discharged from car 10, the operating shaft assembly 130 is rotated to close the gate 70. When the operating shaft assembly 130 is rotated to close the gate 70, the shaft 134 initially traverses the angular or radial distance separating walls or surfaces 187 and 188 within the slotted recesses 184 on the pinions 146 until the outer surface of shaft 134 engages with walls or surface 187 within the slotted recesses 184 on the pinions 146. Continued rotation of the operating shaft assembly 130 imparts rotation to the pinions 146 which is transmuted to linear displacement of the gate 70 toward the closed position by the rack and pinion assembly 142. When the gate 70 reaches the closed position, the cam structure 166 is disposed as shown in FIG. 12. Accordingly, the effects of gravity and the influence of the spring 178 (FIGS. 9 and 10) urge the stop 152, 152' of lock assembly 150 into the position shown in FIG. 11 whereby again releasably locking the gate 70 in the closed position or condition.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A low profile discharge gate assembly for a railroad hopper car, said gate assembly comprising:

a rigid frame including a pair of side frame members rigidly joined to a pair of end frame members in a generally rectangular design and defining a discharge opening through which commodity is adapted to gravitationally pass, with said frame including a plurality of supports extending in generally parallel relation relative to each other and between said end frame members;

a gate supported on said plurality of spaced supports for linear movement as said gate moves in a single generally horizontal path of travel between a closed position, wherein said gate prevents a flow of commodity through said discharge opening, and an open position;

wherein said each side frame member and each end frame member includes an upper outwardly extending flange, with the upper flanges on said side frame members and end frame members being arranged above an upper surface of the gate and in generally coplanar relation relative to each other, and with each side frame member and each end frame member having a horizontally slanted wall extending downwardly and away from the respective upper flange on each side frame member and each end frame member and inwardly toward the discharge opening so as to define an included angle of less than 30 degrees relative to a horizontal plane defined by the coplanar relation of the upper flanges relative to each other; and wherein said each side frame member and each end frame member includes a lower outwardly extending flange, with the lower flanges on said side frame members and end frame members being arranged below a lower surface of the gate and in generally coplanar relation relative to each other, with a vertical distance of less than 7.5 inches separating a lowermost surface on the lower flange of each side frame member and each end frame member from an upper surface on the upper flange of each side frame member and each end frame member whereby lending a low profile to said gate assembly;

structure carried by said side frame members and at least one of said end frame members and disposed between the lower flanges on said side frame members and at least one of said end frame members and said gate, said structure including a series of horizontally slanted surfaces extending inwardly from at least three sides of said discharge opening for restricting commodity flow passing from the discharge opening of said gate assembly, with said surfaces on said structure being horizontally slanted at an angle ranging between about 25 degrees and less than 45 degrees relative to a horizontal plane;

seal structure arranged in sealing engagement with the upper surface of and toward a periphery of said gate;

an operating shaft assembly supported by extensions of said side frame members for rotation about a fixed axis, with said operating shaft assembly being operably coupled to said gate; and a lock assembly for inhibiting inadvertent movement of the gate toward the open position from the closed position.

2. The low profile gate assembly according to claim 1, wherein the structure carried by said frame members and disposed between the lower flanges on the side frame members and at least one end frame member of said gate assembly is formed integral with the side frame members and at least one end frame member of said gate assembly.

3. The low profile gate assembly according to claim 1, wherein said operating shaft assembly is operably coupled to the gate through pinions mounted on a shaft rotatable about said fixed axis, with said pinions being arranged in intermeshing relation with racks carried on said gate.

4. The low profile gate assembly according to claim 1, wherein one end of each of said plurality of said supports is secured to the end frame member disposed the furthest distance from said operating shaft assembly, with each support extending through an opposed end frame member to allow a portion of each support to guide and support the shaft of said operating shaft assembly thereby limiting deflection of said shaft relative to said fixed axis when said shaft is rotated to move said gate toward the open position.

5. The low profile gate assembly according to claim 1, wherein said lock assembly is operable in timed relation relative to rotation of said operating shaft assembly for positively removing a stop from the path of travel of said gate prior to movement of said gate from the closed position toward the open position.

6. The low profile gate assembly according to claim 5, wherein the stop of said lock assembly, when said gate is in the closed position, positively engages with the gate thereby preventing inadvertent movement of the gate toward the open position.

7. The low profile gate assembly according to claim 1, further including a lost motion mechanism which collapses upon rotation of said operating shaft assembly in a direction to move said gate toward the open position whereafter said operating shaft assembly is operably coupled to said gate.

8. A low profile discharge gate assembly for a railroad hopper car, said gate assembly comprising:

a rigid frame including a pair of laterally spaced and generally parallel side frame members and a pair of longitudinally spaced and generally parallel end frame members fixed between the side frame members to define a discharge opening through which commodity is adapted to gravitationally pass, with said frame including a plurality of laterally spaced supports extending in generally parallel relation relative to each other and between said end frame members;

a gate supported on said plurality of supports for linear sliding movement along a single predetermined and generally horizontal path of travel between closed and open positions, wherein said gate includes upper and lower generally parallel surfaces;

wherein said side frame members and end frame members each includes an upper outwardly extending flange, with the upper flanges on said side frame members and end frame members being arranged above the upper surface of the gate and in generally coplanar relation relative to each other, a horizontally slanted wall extending downwardly and away from the respective upper flange on each side frame member and each end frame member and inwardly toward the discharge opening so as to define an included angle less than 30 degrees relative to a horizontal plane defined by the coplanar relation of the upper flanges relative to each other, and a depending wall extending generally perpendicular and joined to the upper flange of each frame member, with said depending wall being joined above an upper surface of the gate to a terminal edge of the respective horizontally slanted wall of said frame members and extends below the lower surface of the gate; and wherein said each side frame member and each end frame member further includes a lower outwardly extending flange, with the lower flanges on said side frame members and end frame members being arranged below the upper surface of the gate and in generally coplanar relation relative to each other, with a vertical distance of less than 7.5 inches separating a lowermost surface on the lower flange of each side frame member and each end frame member from an upper surface on the upper flange of each side frame member and each end frame member whereby yielding a low profile to said gate assembly;

structure carried by said both side frame members and one of said end frame members and disposed between the lower flanges on said side frame members and said one of said end frame members and the lower surface of said gate, said structure including a series of horizontally slanted surfaces extending inwardly from and joining the depending wall of both side frame members and said one of said end frame members with the lower outwardly extending flanges thereon so as to restrict commodity flow passing from said gate assembly, with the horizontally slanted surfaces of said structure on at least the side frame members being joined to said depending wall below the lower surface of said gate;

seal structure arranged in sealing engagement with the upper surface of and toward a periphery of said gate;

an operating shaft assembly supported by extensions of said side frame members for rotation about a fixed axis, with said operating shaft assembly being operably coupled to said gate; and a lock assembly for inhibiting inadvertent movement of the gate toward the open position.

9. The low profile gate assembly according to claim 8, wherein the horizontally slanted surfaces on said structure carried by said frame members and disposed between the lower flanges on the side frame members and at least one end frame member of said gate assembly are horizontally slanted at an angle ranging between about 25 degrees and about 45 degrees relative to a horizontal plane.

10. The low profile gate assembly according to claim 8, wherein the structure carried by said frame members and disposed between the lower flanges on the side frame members and at least one end frame member of said gate assembly is formed integral with the side frame members and at least one end frame member of said gate assembly.

11. The low profile gate assembly according to claim 8, wherein said operating shaft assembly is operably coupled to the gate through pinions mounted on a shaft rotatable about said fixed axis, with said pinions being arranged in intermeshing relation with racks carried on said gate.

12. The low profile gate assembly according to claim 8, wherein one end of each of said plurality of supports is secured to the end frame member disposed the furthest distance from said operating shaft assembly, with each support extending through an opposed end frame member to allow a portion of each support to guide and support the shaft of said operating shaft assembly thereby limiting deflection of said shaft relative to said fixed axis when said shaft is rotated to move said gate toward the open position.

13. The low profile gate assembly according to claim 8, wherein said lock assembly is operable in timed relation relative to rotation of said operating shaft assembly for positively removing a stop from the path of travel of said gate prior to movement of said gate from the closed position toward the open position.

14. The low profile gate assembly according to claim 13, wherein the stop of said lock assembly, when said gate is in the closed position, positively engages with the gate thereby preventing inadvertent movement of the gate toward the open position.

15. The low profile gate assembly according to claim 14, wherein a mechanical system is provided between the stop of said lock assembly and the operating shaft assembly, with said mechanical system including a lost motion mechanism which collapses upon rotation of said operating shaft assembly in a direction to move said gate toward the open position whereafter said operating shaft assembly is operably coupled to said gate.

16. A low profile discharge gate assembly adapted to be secured in material receiving relation relative to a standard opening defined toward a bottom of a railroad hopper car, said gate assembly comprising:

a rigid frame including a pair of laterally spaced and generally parallel side frame members and first and second longitudinally spaced and generally parallel end frame members fixed between the side frame members so as to define a ledgeless discharge opening for said gate assembly through which commodity is adapted to pass, with said frame including a plurality of laterally spaced supports extending in generally parallel relation relative to each other and between said end frame members;

a gate supported on said plurality of supports for linear sliding movement along a single predetermined and generally horizontal path of travel between closed and open positions, wherein said gate includes upper and lower generally parallel surfaces;

wherein said side frame members and end frame members each include an upper outwardly extending flange, with the upper flanges on said side frame members and end frame members being arranged above the upper surface of the gate and in generally coplanar relation relative to each other and defining a bolting pattern generally corresponding to a standard bolting pattern surrounding the standard opening toward the bottom of the railroad hopper car whereby facilitating securement of the gate assembly to the hopper car, with each side frame member and each side frame further having a horizontally slanted wall extending downwardly and away from the respective upper flange on each side frame member and each end frame member and inwardly toward a center of the ledgeless discharge opening so as to define an included angle of less than 30 degrees relative to a horizontal plane defined by the coplanar relation of the upper flanges relative to each other, a depending wall extending generally perpendicular and joined to the upper flange of each frame member and extending below the lower surface of the gate, and with said second end frame member being configured to allow said gate to extend therethrough; and wherein said each side frame member and each end frame member further includes a lower flange extending generally parallel to the upper flange, with the lower flanges on said side frame members and end frame members being arranged below the lower surface of the gate and in generally coplanar relation relative to each other, with a vertical distance of less than 7.5 inches separating a lowermost surface on the lower flange of each side frame member and each end frame member from an upper surface on the upper flange of each side frame member and each end frame member whereby yielding a low profile to said gate assembly;

structure carried by both of said side frame members and said second end frame member and disposed between the lower flanges on said frame members and the lower surface of said gate, said structure including a series of horizontally slanted surfaces extending inwardly from a terminal edge of and joining the respective depending wall of both side frame members and said second end frame member with the respective lower flange below the lower surface of the gate such that said gate assembly defines another discharge opening disposed beneath said ledgeless discharge opening, with said another discharge opening being sized to restrict commodity flow passing from said the ledgeless discharge opening of said gate assembly;

seal structure arranged in sealing engagement with the upper surface of and toward a periphery of said gate;

an operating shaft assembly supported by extensions of said side frame members for rotation about a fixed axis, with said operating shaft assembly being operably coupled to said gate; and a lock assembly for inhibiting inadvertent movement of the gate toward the open position.

17. The low profile gate assembly according to claim 16, wherein the slanted surfaces on said structure carried by said frame members and disposed between the lower flanges on said side frame members and said second end frame member of said gate assembly are horizontally slanted at an angle ranging between about 25 degrees and about 45 degrees relative to a horizontal plane.

18. The low profile gate assembly according to claim 16, wherein the structure carried by said frame members and disposed between the lower flanges on the side frame members and said second end frame member is formed integral with the side frame members and said second end frame member of said gate assembly.

19. The low profile gate assembly according to claim 16, wherein said operating shaft assembly is operably coupled to the gate through pinions mounted on a shaft rotatable about said fixed axis, with said pinions being arranged in intermeshing relation with racks carried on said gate assembly frame.

20. The low profile gate assembly according to claim 19, wherein the shaft of said operating shaft assembly extends transversely across the predetermined path of travel of said gate and includes capstans arranged at opposite ends thereof, said capstans being disposed for engagement from either side of said gate assembly.

21. The low profile gate assembly according to claim 16, wherein said plurality of laterally spaced supports includes a first support extending generally along an axis of said gate assembly in parallel relation relative to the direction in which said gate moves between the closed and open positions along with second and third supports disposed to opposed sides lateral sides of said first support member.

22. The low profile gate assembly according to claim 21, wherein an upper surface of each support is provided with material for enhancing the ability of the gate to slide thereacross as the gate moves between closed and open positions.

23. The low profile gate assembly according to claim 16, wherein one end of each support is secured to the end frame member disposed the furthest distance from said operating shaft assembly, with each support extending through an opposed end frame member to allow a portion of each support to guide and support the shaft of said operating shaft assembly thereby limiting deflection of said shaft relative to said fixed axis when said shaft is rotated to move said gate toward the open position.

24. The low profile gate assembly according to claim 16, wherein said lock assembly is operable in timed relation relative to rotation of said operating shaft assembly for positively removing a stop from the path of travel of said gate prior to movement of said gate from the closed position.

25. The low profile gate assembly according to claim 24, wherein the stop of said lock assembly, when said gate is in the closed position, positively engages with the gate thereby preventing inadvertent movement of the gate toward the open position.

26. The low profile gate assembly according to claim 24, wherein a mechanical system is provided between the stop of said lock assembly and the operating shaft assembly, with said mechanical system including a lost motion mechanism which collapses upon rotation of said operating shaft assembly in a direction to move said gate toward the open position whereafter said operating shaft assembly is operably coupled to said gate.

27. A low profile discharge gate assembly for a railroad hopper car, said gate assembly comprising:

a rigid frame including a pair of laterally spaced and generally parallel side frame members and first and second longitudinally spaced and generally parallel end frame members fixed between the side frame members, with said frame defining a first discharge opening having a cross-sectional area of about 1100 square inches, and with said frame including a plurality of laterally spaced supports extending in generally parallel relation relative to each other and between said end frame members;

a gate supported on said supports for linear sliding movement along a single predetermined and generally horizontal path of travel between closed and open positions, wherein said gate includes upper and lower generally parallel surfaces;

wherein said side frame members and end frame members each includes an upper outwardly extending flange, with the upper flanges on said side frame members and end frame members being arranged above the upper surface of the gate and in generally coplanar relation relative to each other and defining a 13×42 bolting pattern, a horizontally slanted wall extending downwardly and away from the respective upper flange on each frame member and inwardly toward a center of the discharge opening so as to define an included angle of less than 30 degrees relative to a horizontal plane defined by the coplanar relation of the upper flanges relative to each other, and a depending wall extending generally perpendicular and joined to the upper flange of each frame member, and with each depending wall being joined above the upper surface of the gate to a terminal edge of the horizontally slanted wall of the respective frame member and extends below the lower surface of the gate, and with said second end frame member being configured to allow said gate to extend therethrough;

wherein each side frame member and each end frame member further includes a lower outwardly extending flange, with the lower flanges on said side frame members and end frame members being arranged below the lower surface of the gate and in generally coplanar relation relative to each other, with a vertical distance of less than 7.5 inches separating a lowermost surface on the lower flange of each side frame member and each end frame member from an upper surface on the upper flange of each side frame member and each end frame member whereby yielding a low profile to said gate assembly;

structure carried by said both side frame members and said second end frame member and disposed between the lower flanges on said side frame members and said second end frame member and the lower surface of said gate, said structure including a series of horizontally slanted surfaces extending inwardly from and joining the depending wall of both side frame members and said second end frame member with the lower outwardly extending flanges thereon such that said gate assembly defines a second discharge opening disposed beneath said first discharge opening, with said second discharge opening having a cross-sectional area sized between about 25% and about 40% smaller than the cross-sectional size of said first discharge opening of said gate assembly so as to restrict flow of commodity from said gate assembly, and with the horizontally slanted surfaces of said structure on said two side frame members and said second end frame member being joined to the respective depending wall below and in spaced relation with the lower surface of the gate;

seal structure arranged in sealing engagement with the upper surface of and toward a periphery of said gate;

an operating shaft assembly supported by extensions of said side frame members for rotation about a fixed axis, with said operating shaft assembly being operably coupled to said gate; and a lock assembly for inhibiting inadvertent movement of the gate toward the open position.

28. The low profile gate assembly according to claim 27, wherein the slanted surfaces on said structure carried by said frame members and disposed between the lower flanges on the side frame members and said second end frame member and the lower surface of said gate are horizontally slanted at an angle ranging between about 25 degrees and about 45 degrees relative to a horizontal plane.

29. The low profile gate assembly according to claim 27, wherein the structure carried by said frame members and disposed between the lower flanges on the side frame members and said second end frame member of said gate assembly is formed integral with the side frame members and said second end frame member of said gate assembly.

30. The low profile gate assembly according to claim 27, wherein said operating shaft assembly is operably coupled to the gate through pinions mounted on a shaft rotatable about said fixed axis, with said pinions being arranged in intermeshing relation with racks carried on said gate.

31. The low profile gate assembly according to claim 30, wherein the shaft of said operating shaft assembly extends transversely across the predetermined path of travel of said gate and includes capstans arranged at opposite ends thereof, said capstans being disposed for engagement from either side of said gate assembly.

32. The low profile gate assembly according to claim 27, wherein said plurality of laterally spaced supports includes a first support extending generally along an axis of said gate assembly in parallel relation relative to the direction in which said gate moves between the closed and open positions along with second and third supports disposed to opposed lateral sides of said first support.

33. The low profile gate assembly according to claim 27, wherein an upper surface of each support is provided with material for enhancing the ability of the gate to slide thereacross as the gate moves between closed and open positions.

34. The low profile gate assembly according to claim 27, wherein one end of each support is secured to the end frame member disposed the furthest distance from said operating shaft assembly, with each support extending through an opposed end frame member to allow a portion of each support to guide and support the shaft of said operating shaft assembly thereby limiting deflection of said shaft relative to said fixed axis when said shaft is rotated to move said gate toward the open position.

35. The low profile gate assembly according to claim 27, wherein said lock assembly is operable in timed relation relative to rotation of said operating shaft assembly for positively removing a stop from the path of travel of said gate prior to movement of said gate from the closed position toward the open position.

36. The low profile gate assembly according to claim 35, wherein the stop of said lock assembly, when said gate is in the closed position, positively engages with the gate thereby preventing inadvertent movement of the gate toward an open position.

37. The low profile gate assembly according to claim 36, wherein a mechanical system is provided between the stop of said lock assembly and the operating shaft assembly, with said mechanical system including a lost motion mechanism which collapses upon rotation of said operating shaft assembly in a direction to move said gate toward the open position whereafter said operating shaft assembly is operably coupled to said gate.

38. The low profile gate assembly according to claim 37, wherein said mechanical system includes cam structure disposed adjacent to an extension of at least one of said side frame members to minimize the effect high torque requirements imparted to said operating shaft assembly have on operation of said lock assembly.

39. The low profile gate assembly according to claim 37, wherein said mechanical system includes a lost motion mechanism which collapses upon rotation of said operating shaft assembly in a direction to move said gate toward the open position whereafter said operating shaft assembly is operably coupled to said gate.

40. A railroad hopper car discharge gate assembly, said gate assembly comprising:

a rigid frame including a pair of side frame members rigidly joined to a pair of end frame members in a generally rectangular design and defining a discharge opening through which commodity is adapted to gravitationally pass, with said frame including a plurality of laterally spaced supports extending in generally parallel relation relative to each other and between said end frame members;

a gate having an upper surface and which is slidably movable on said supports, with said gate being arranged for linear movement in a single generally horizontal path of travel between a closed position, wherein said gate prevents a flow of commodity through said discharge opening, and an open position;

wherein said each side frame member and each end frame member includes an upper outwardly extending flange, with the upper flanges on said side frame members and end frame members being arranged above the upper surface of the gate and in generally coplanar relation relative to each other, and with each side frame member and each end frame member having a horizontally slanted wall extending downwardly and away from the respective upper flange on each side frame member and each end frame member and inwardly toward the discharge opening; and with each side frame member and each end frame member having a wall depending from a terminal end of the respective slanted wall;

seal structure carried by said end frame members and said side frame members and arranged in sealing engagement with the upper surface of and toward a periphery of said gate;

an operating shaft assembly supported by extensions of said side frame members for rotation about a fixed axis extending generally parallel to and adjacent to one of said end frame members on said rigid frame, with said operating shaft assembly including an elongated shaft which rotates about said fixed axis and is operably coupled to said gate;

a lock assembly for inhibiting inadvertent movement of the gate toward the open position; and wherein the supports for said gate are secured at one end to the end frame member disposed the furthest distance from said operating shaft assembly and extends lengthwise through the other end frame member, and with an opposed end of the supports extending endwise through said other end frame member, and wherein the shaft of said operating shaft assembly extends through and is guided and supported by said opposed end of the supports so as to limit deflection of said shaft relative to said fixed axis when said shaft is rotated to move said gate toward the open position.

41. The railroad hopper car discharge gate assembly according to claim 40, wherein the discharge opening defined by said end frame members and side frame members of said rigid frame has a ledgeless design.

42. The railroad hopper car discharge gate assembly according to claim 40, wherein said plurality of supports includes a generally centralized support extending generally along an axis of said gate assembly in generally parallel relation relative to the direction in which said gate moves between closed and open positions along with an additional support forming part of said frame disposed to opposed lateral sides of and extending generally parallel to said generally centralized support.

43. The railroad hopper car discharge gate assembly according to claim 40, wherein an upper surface of said supports is provided with material for enhancing the ability of the gate to slide thereacross as the gate moves between closed and open positions.

44. The railroad hopper car discharge gate assembly according to claim 40, wherein each support for guiding and supporting the shaft of said operating shaft assembly defines a closed marginal bore through which the shaft of said operating shaft assembly extends.

45. A gate assembly for a railroad hopper car, said gate assembly comprising:

a rigid frame including a pair of side frame members rigidly joined to first and second end frame members in a generally rectangular design and defining a discharge opening through which commodity is adapted to gravitationally pass, with said frame including a plurality of laterally spaced supports extending in generally parallel relation relative to each other and between said end frame members;

a gate having an upper surface and a generally parallel lower surface, with the lower surface of said gate being supported on said plurality of spaced supports for linear movement in a single generally horizontal path of travel between a closed position, wherein said gate prevents a flow of commodity through said discharge opening, and an open position;

wherein each of said frame members includes an upper outwardly extending flange, with the upper flanges on said frame members being arranged above the upper surface of the gate and in generally coplanar relation relative to each other, and with said frame members having a horizontally slanted wall extending downwardly and away from the respective upper flange on said frame member and inwardly toward a center of the discharge opening so as to define an acute angle relative to a horizontal plane defined by the coplanar relation of the upper flange relative to each other, and with each frame member further including a generally vertical wall joined to and extending generally perpendicular to the upper flange of each frame member; and with said generally vertical wall being joined above the upper surface of said gate to a terminal edge of the respective horizontally slanted wall of said frame members and extends below the lower surface of said gate, and with said second end frame member being configured to accommodate passage of said gate therethrough;

wherein said each side frame member and each end frame member includes a lower outwardly extending flange, with the lower flanges on said side frame members and end frame members being arranged below the lower surface of the gate and in generally coplanar relation relative to each other;

structure carried by said side frame members and said second end frame member for restricting commodity flow passing from the discharge opening of said gate assembly, said structure including a series of horizontally slanted surfaces extending inwardly from and joining the generally vertical wall and the lower flanges of each of said side frame members and said second end frame member, and with the horizontally slanted surfaces of said structure on the two side frame members and said second end frame member being joined to said generally vertical wall below and in spaced relation with the lower surface of the gate;

seal structure arranged in sealing engagement with the upper surface of and toward a periphery of said gate;

an operating shaft assembly supported by extensions of said side frame members for rotation about a fixed axis, with said operating shaft assembly being operably coupled to said gate; and a lock assembly for inhibiting inadvertent movement of the gate toward the open position.

46. The gate assembly according to claim 45, wherein the structure carried by said frame members and disposed between the lower flanges on the side frame members and said second end frame member is formed integral with the side frame members and said second end frame member of said gate assembly.

47. The gate assembly according to claim 45, wherein said operating shaft assembly is operably coupled to the gate through pinions mounted on a shaft rotatable about said fixed axis, with said pinions being arranged in intermeshing relation with racks carried on said gate.

48. The low profile gate assembly according to claim 47, wherein the shaft of said operating shaft assembly extends transversely across the predetermined path of travel of said gate and includes capstans arranged at opposite ends thereof, said capstans being disposed for engagement from either side of said gate assembly.

49. The gate assembly according to claim 45, wherein said plurality of laterally spaced supports includes a first support extending generally along an axis of said gate assembly in parallel relation relative to the direction in which said gate moves between the closed and open positions along with second and third supports disposed to opposed lateral sides of said first support.

50. The gate assembly according to claim 49, wherein an upper surface of each support is provided with material for enhancing the ability of the gate to slide thereacross as the gate moves between closed and open positions.

51. The gate assembly according to claim 45, wherein one end of the supports is secured to the end frame member disposed the furthest distance from said operating shaft assembly, with said supports extending through an opposed end frame member to allow a portion of said supports to guide and support the shaft of said operating shaft assembly thereby limiting deflection of said shaft relative to said fixed axis when said shaft is rotated to move said gate toward the open position.

52. The gate assembly according to claim 45, wherein said lock assembly is operable in timed relation relative to rotation of said operating shaft assembly for positively removing a stop from the path of travel of said gate prior to movement of said gate from the closed position toward the open position.

53. The gate assembly according to claim 52, wherein the stop of said lock assembly, when said gate is in the closed position, positively engages with the gate thereby preventing inadvertent movement of the gate toward an open position.

54. The gate assembly according to claim 53, wherein a mechanical system is provided between the stop of said lock assembly and the operating shaft assembly, with said mechanical system including a lost motion mechanism which collapses upon rotation of said operating shaft assembly in a direction to move said gate toward the open position whereafter said operating shaft assembly is operably coupled to said gate.

55. The gate assembly according to claim 54, wherein said mechanical system includes cam structure disposed adjacent to the extension of at least one of said side frame members to minimize the effect high torque requirements imparted to said operating shaft assembly have on operation of said lock assembly.

56. The gate assembly according to claim 54, wherein said mechanical system includes a lost motion mechanism which collapses upon rotation of said operating shaft assembly in a direction to move said gate toward the open position whereafter said operating shaft assembly is operably coupled to said gate.

* * * * *